US007496985B1

(12) United States Patent
Morad

(10) Patent No.: US 7,496,985 B1
(45) Date of Patent: Mar. 3, 2009

(54) MULTIPURPOSE CLEANING APPARATUS

(75) Inventor: Fred I. Morad, Toluca Lake, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 158 days.

(21) Appl. No.: 11/490,379

(22) Filed: Jul. 20, 2006

(51) Int. Cl.
*A47K 7/02* (2006.01)

(52) U.S. Cl. ..... 15/228; 15/208; 15/229.4; 15/229.6; 15/229.8; 15/230.16; 15/230.17

(58) Field of Classification Search ..... 15/208, 15/228, 229.4, 229.6, 229.8, 230.16, 230.17
See application file for complete search history.

(56) References Cited

U.S. PATENT DOCUMENTS 5,926,896 A * 7/1999 Allemann et al. ..... 15/147.2
7,039,969 B2 * 5/2006 Zorzo ..... 15/147.1

* cited by examiner

*Primary Examiner*—Joseph J Hail, III
*Assistant Examiner*—Shantese McDonald
(74) *Attorney, Agent, or Firm*—Thomas I. Rozsa

(57) ABSTRACT

The present invention is a multipurpose cleaning apparatus for cleaning a variety of surfaces which includes an apparatus for removably retaining a reusable cleaning swifter, an apparatus for removably retaining a disposable cleaning cloth, an apparatus for removably retaining a brush and an apparatus for removably retaining a scouring pad. The apparatus comprises a base having two hingeably attached sections which can be rotated to form a angle so that the swifter can be attached, rotated to form a rigid elongated structure to retain the disposable cleaning cloth through locking clasp assemblies, and configured to receive members which retain gripping members to removably retain a cleaning brush and a scouring pad.

11 Claims, 13 Drawing Sheets

MULTIPURPOSE CLEANING APPARATUS

BACKGROUND OF THE INVENTION

1. Field of the Invention

The present invention relates to the field of cleaning devices and more particularly to multipurpose cleaning implements 2. Description of the Prior Art Handheld cleaning devices such as mops, brooms, brushes, and disposable dusters are widely known. Many advances have been made with respect to each apparatus in order to reduce time spent cleaning and to simplify the cleaning process.

Cleaning devices exist which make use of reusable materials where a user may clean a surface and subsequently rinse the cleaning material and reuse it at a later time. Advances in materials and production have brought about the use of disposable cleaning materials. Initially these materials were used to dust or pick up debris on dry surfaces. Currently disposable cleaning sheets exist that are highly durable and inexpensive enough to be disposable subsequent to use. Devices configured for disposable cloths are widely known. These devices enable a user to quickly dust and clean a floor and discard the used cloth subsequent to use. This is advantageous in that it saves cleaning time as most cloths have been adapted to pick up lint, pollen, pet dander, and other unwanted debris. A clean up pan is no longer needed and the user does not need to bend over in order to pick up the collected debris. After use the user may easily discard the used cloth and store the cleaning tool. While the cloths work well for small areas and small debris, for larger areas and larger sized debris, the disposable cloths tend to be limited in this capacity.

Brooms are widely known in the art.

There is a significant need a need for a multipurpose cleaning device that may be used as a broom, a duster utilizing reusable and disposable cleaning cloths, a scrubber, and a mop.

SUMMARY OF THE INVENTION

The present invention is a multipurpose cleaning apparatus for cleaning a variety of surfaces which includes an apparatus for removably retaining a reusable cleaning swifter, an apparatus for removably retaining a disposable cleaning cloth, an apparatus for removably retaining a brush and an apparatus for removably retaining a scouring pad. The apparatus comprises a base having two hingeably attached sections which can be rotated to form a angle so that the swifter can be attached, rotated to form a rigid elongated structure to retain the disposable cleaning cloth through locking clasp assemblies, and configured to receive members which retain gripping members to removably retain a cleaning brush and a scouring pad.

It has been discovered, according to the present invention, that if a base portion contains a collapsible hinge integrated within the bottom of the base, a cleaning tool may be configured to accept reusable cleaning cloth or swifter.

It has further been discovered, according to the present invention, that if a base portion contains a collapsible hinge integrated within the bottom of the base and a locking mechanism configured to secure the top two portions comprising the base, the cleaning tool will be sufficiently durable to support the weight of larger cleanups. Further, the combination of the collapsible hinge and locking mechanism facilitate affixing the cloth to the device and removing the cloth subsequent to use.

It is therefore an object of the present invention to provide a multipurpose cleaning tool comprised of two portions connected at a common edge by a hinge that allows the two sides to be coplanar or folded inward for adapting the tool with reusable cloth material; the two portions being further equipped with rotatable clasps for securing a disposable cloth.

It is also an object of the present invention to provide a multipurpose cleaning tool with a flat bottom portion equipped with internal side channels that are configured to accept acceptable gripping bars for affixing brushes or scouring pads thereto.

It is an additional object of the present invention to provide a multipurpose cleaning apparatus which has features which enable the apparatus to removably receive a reusable swifter and retrain it in one configuration and alternatively retain it in a more secure configuration, also retain a disposable cleaning cloth after the swifter is removed, also removably retain a cleaning brush after the other cleaning objects have been removed an also retain a scouring pad after he cleaning brush has been removed.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is an all-in-one multipurpose cleaning apparatus which can removably retain a reusable swifter in two different ways, a disposable cleaning cloth, a reusable cleaning brush and a reusable or disposable scouring pad.

The multipurpose cleaning apparatus will first be described for use with a reusable swifter or fabric cleaning pad.

Figure 1:
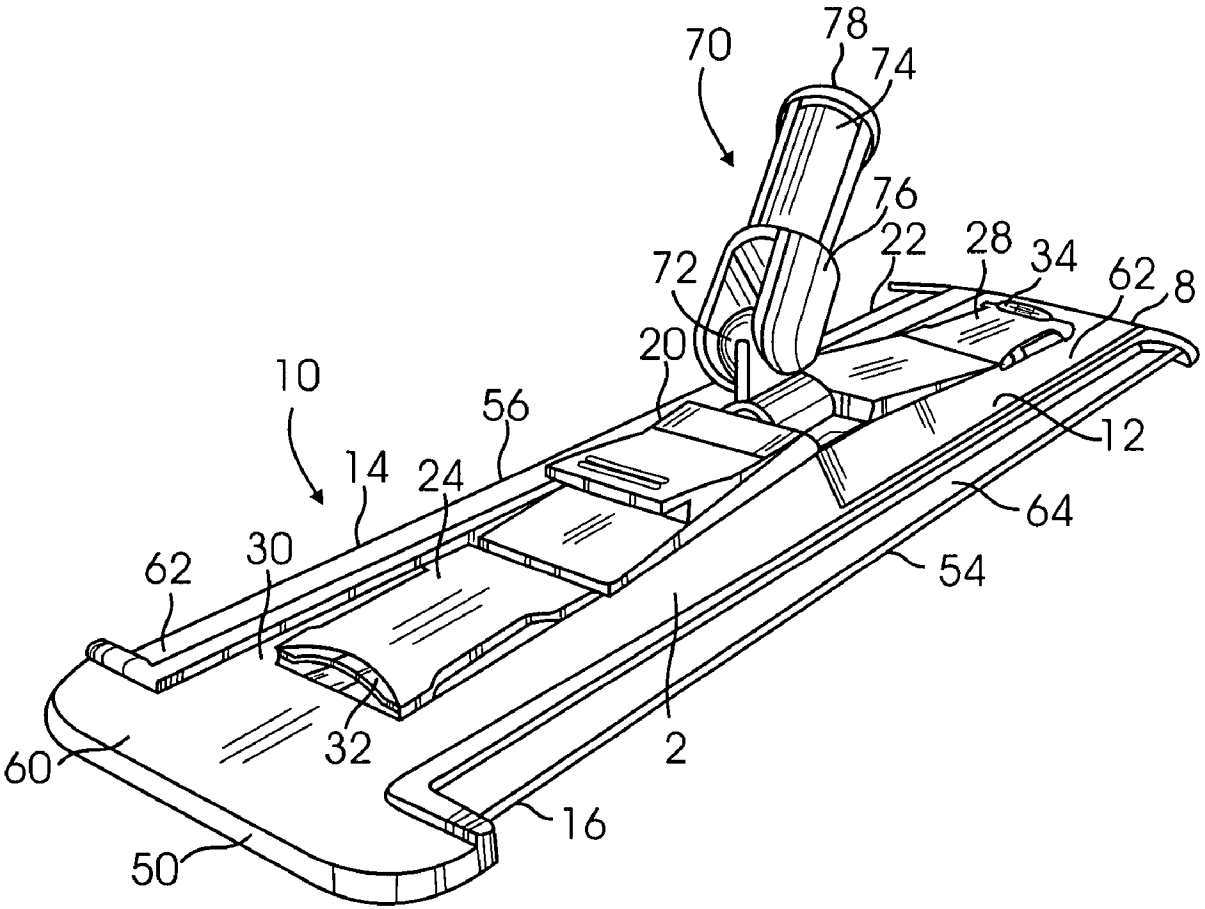
FIG. 1 is a perspective view of the present invention multipurpose cleaning apparatus.
Figure 2:
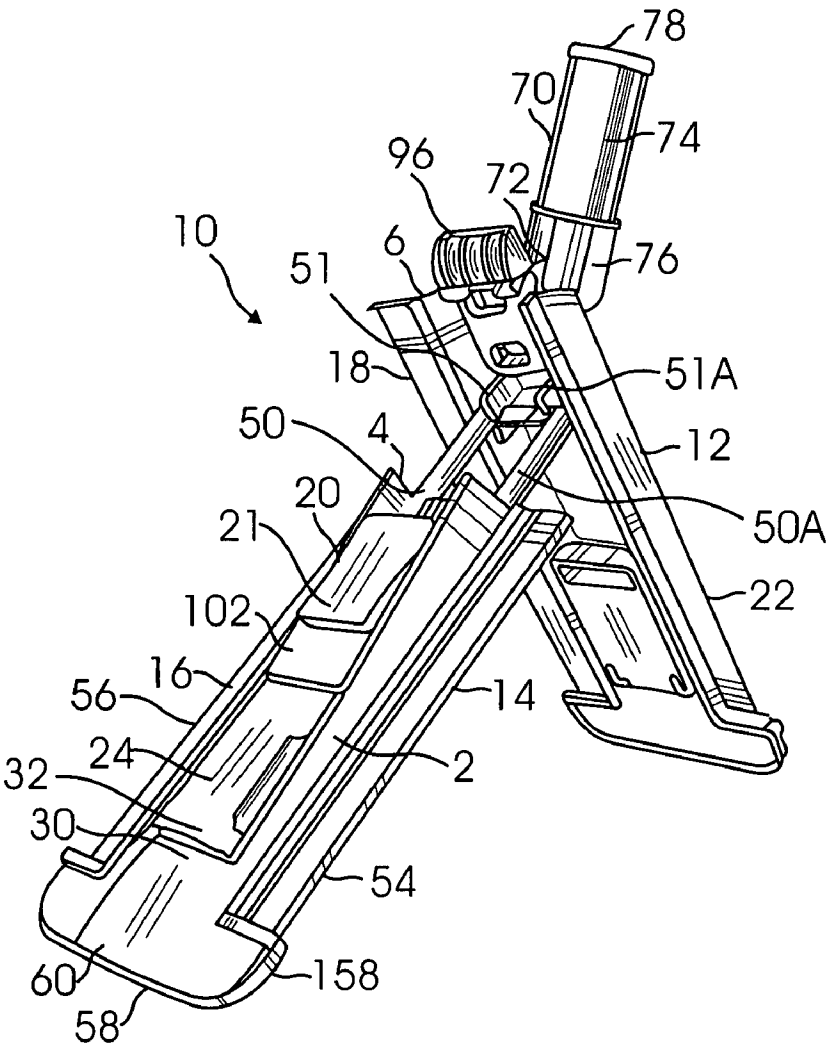
FIG. 2 is a perspective view of the present invention multipurpose cleaning apparatus rotated to a partially folded condition.

Referring the FIG. 1, the multipurpose cleaning apparatus 10 is comprised of a first base portion 2 and a second base portion 12 which can be disengaged from each other to facilitate the slidable attachment of a reusable cloth or swifter 500. Referring to FIGS. 1 and 2 the first base portion 2 and second base portion 12 meet together at an internal first portion second edge 4 and an internal second portion second edge 6. The internal first portion second edge 4 of the first portion 2 is a continuous extension between the first portion first longitudinal side 14 and first portion second longitudinal side 16. The second base portion 12 internal second edge 6 is also a continuous extension between the second portion first longitudinal side 22 and second portion second longitudinal side 18. A rotatable engaging clasp 20 which is rotatably mounted on first base portion 2 is pressed downward on end 21 to come in contact with platform 102 to thereby release a tongue 96 which is positioned between portions of internal second portion second edge 6 so that the two portions 2 and 12 can be rotatably separated as illustrated in FIG. 2. In order to re-engage the two portions 2 and 12, the engaging clasp 20 must once again be rotatably pressed downward so that the tongue 96 can be horizontally positioned between the two portions 2 and 12 and thereby the clasp 20 released to once again lock onto the tongue 96.

Figure 3:
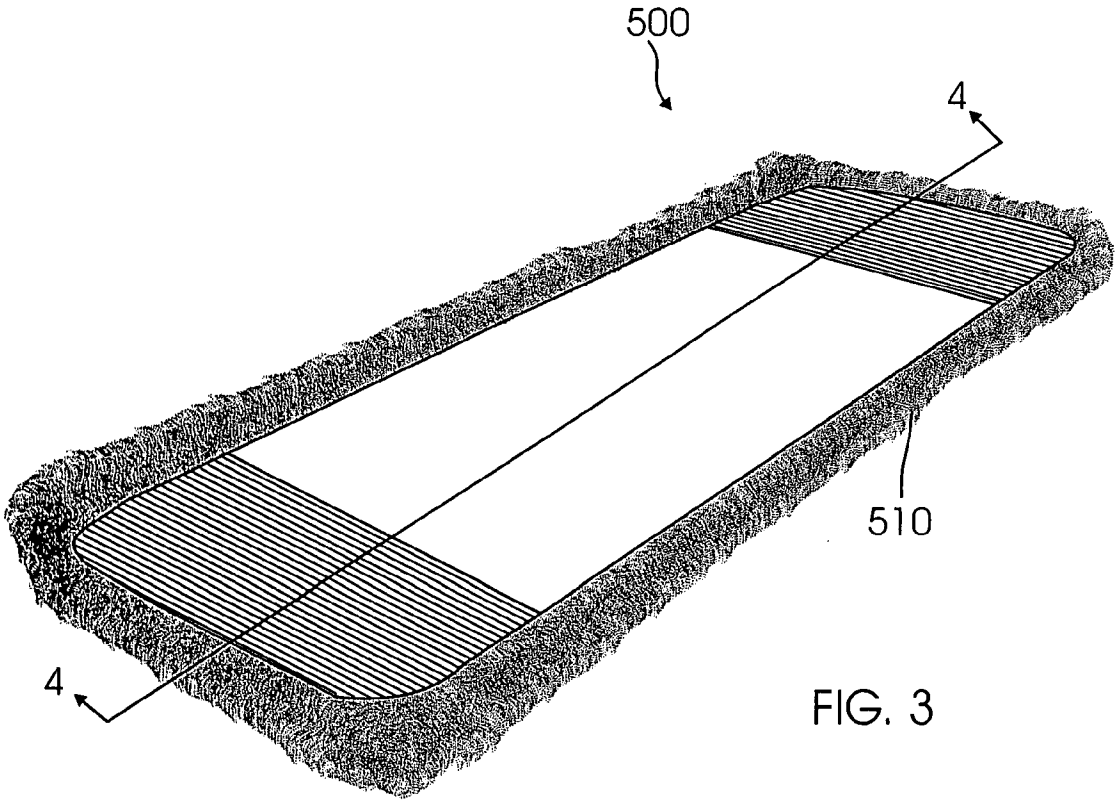
FIG. 3 is a top perspective view of a reusable cleaning swifter mop for use with the present invention multipurpose cleaning apparatus.
Figure 4:
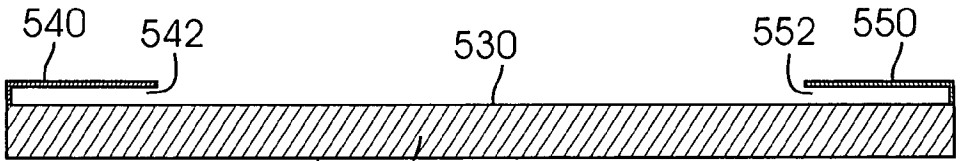
FIG. 4 is a cross-sectional view of the reusable cleaning swifter mop taken along line 4-4 of FIG. 3.
Figure 5:
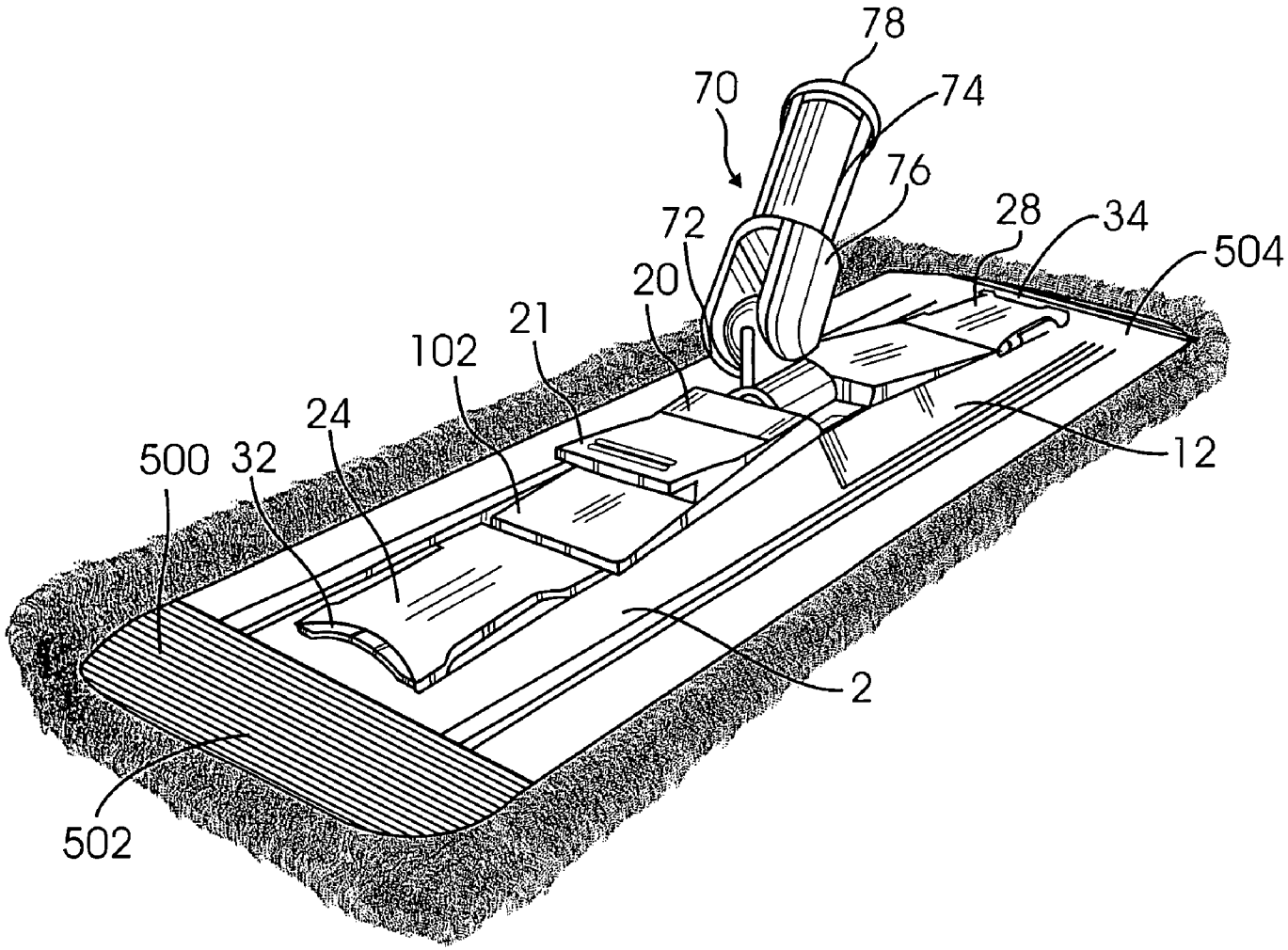
FIG. 5 is a perspective view of a reusable cleaning swifter mop retained in one manner on the present invention multipurpose cleaning apparatus.

Referring to FIGS. 3 and 4, a reusable cleaning cloth or swifter 500 has a cleaning body 510 having a lower cleaning surface 520 and an upper surface 530. The cleaning cloth 500 has a first top retaining member 540 adjacent one end which creates a pocket 542 between the first top retaining member 540 and the upper surface 530 of cleaning body 10. The cleaning cloth 500 has an oppositely disposed second top retaining member 550 adjacent its opposite end which creates a pocket 552 between the first top retaining member 540 and the upper surface 530 of cleaning body 10. After the first base portion 2 and second base portion 12 are rotatably separated as illustrated in FIG. 2, first edge 58 of first portion 2 is inserted into pocket 542 and second edge 8 of second portion 12 is inserted into pocket 552 and thereafter the two portions 2 and 12 are rotated to the closed position as initially illustrated in FIG. 1. The reusable cleaning cloth or swifter 500 is therefore retained by a press fit within the two pockets 542 and 552 as illustrated in FIG. 5. Referring to FIG. 5, affixed to the second portion 12 is handle attachment member 70 which comprises a base portion 72 which rotatably receives the arms of a handle base 76 which in turn supports a handle retaining member 74. The handle retaining member 74 has a centrally disposed opening 78 which receives and retains a handle (not shown). Although illustrated as rotatably or pivotally affixed, it will be appreciated that it is also within the spirit and scope of the present invention for the handle-base attachment portion 76 to take any of a number of configurations as would be appreciated by one having ordinary skill in the art, such as a ball and socket hinge. The multipurpose cleaning apparatus 10 is moved over the surface to be cleaned by being pushed and pulled by the handle. While the configuration illustrated is sufficient to retain the removable and reusable cleaning cloth or swifter 500, for very vigorous cleaning, an additional securing feature is desirable.

Figure 6:
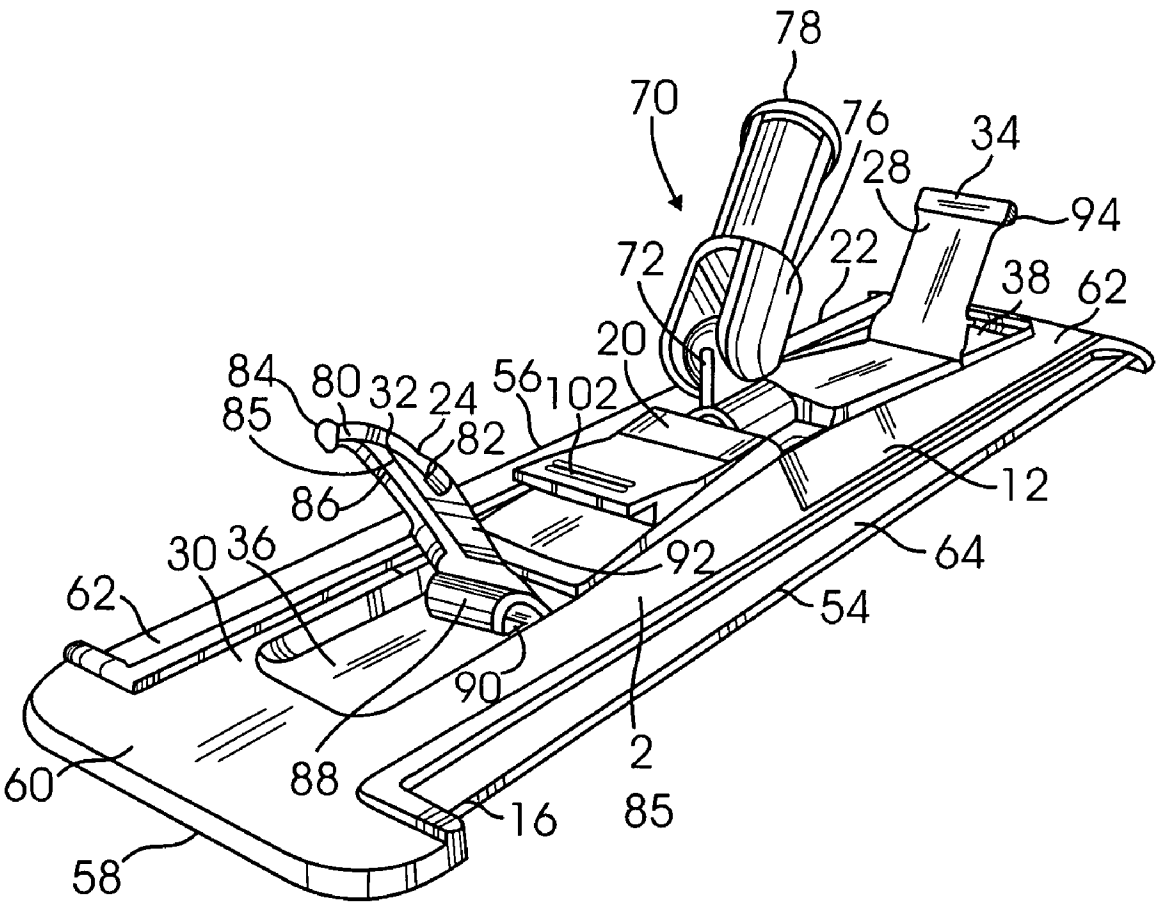
FIG. 6 is a perspective view of the present invention multipurpose cleaning apparatus with the retaining clamps in the open condition.

In order to enhance the fit of a reusable or disposable cleaning cloth or swifter 500 to the first base portion 2 and second base portion 12 of the multipurpose cleaning apparatus 10 during vigorous use, the base portions 2 and 12 are equipped with first hinge locking clasp 24 and a second hinge locking clasp 28. Referring to FIGS. 1 and 6, the top 30 of the first base portion 2 has mounted thereto a first hinge locking clasp 24 for securing the first top retaining member 540 after first edge 58 has been inserted into pocket 542. To facilitate engaging and disengaging the first locking clasp 24, the first locking clasp 24 is contains a grip 32. Similarly the top 62 of the second base portion 12 has mounted thereto a second hinge locking clasp 28 for securing the second top retaining member 550 after second edge 8 has been inserted into pocket 552. To facilitate engaging and disengaging the second locking clasp 28, the second locking clasp 28 is contains a grip 34.

Figure 7:
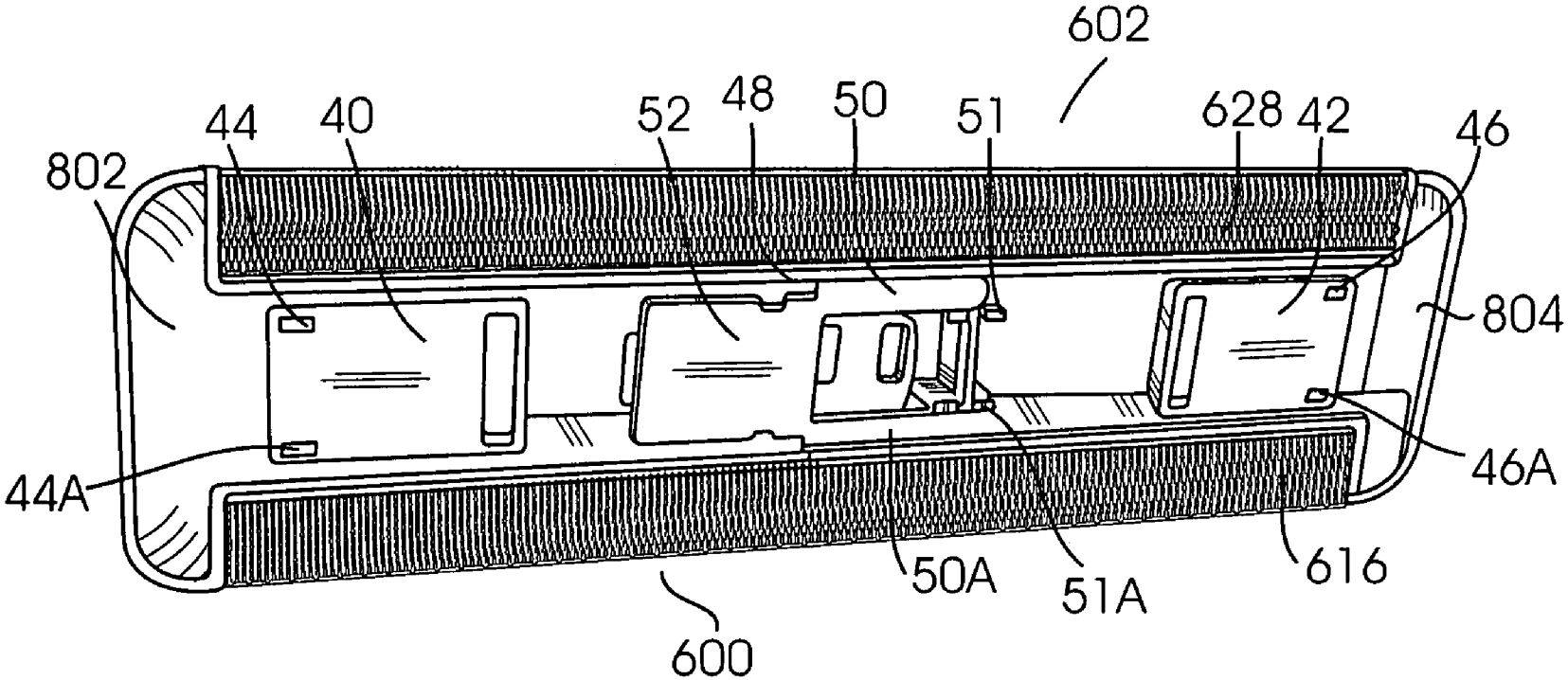
FIG. 7 is a bottom plan view of the present invention multipurpose cleaning apparatus with an accessory attachment in place.

The first locking clasp 24 and the second locking clasp 28 are respectively retained in a first well housing 36 and second well housing 38. Referring to FIG. 7, the bottom 40 of the first locking clasp well 36 and bottom 42 of the second locking clasp well 38 are illustrated. First well housing 36 contains openings 44 and 44A extending transversely therethrough. Similarly, second well housing 38 contains opening 46 and 46A extending transversely therethrough. These transverse openings permit water to drain out of the multipurpose cleaning apparatus 10, thereby preventing stagnating water within each well and also preventing suction pressure from building up when the multipurpose cleaning apparatus 10 is in use in situations that involve partial or total immersion in a liquid. Also illustrated in FIG. 7 and FIG. 2, the bottom center 48 of the first base portion 2 further comprises the moveable collapsing arms 50 and 50A of the collapsible hinge 52, which are rotatably received in retaining members 51 and 51A attached to the underside of second base portion 12. The hinge 52 allows the user to collapse the first portion 2 and second portion 12 as shown in FIG. 2 while the user equips the multipurpose cleaning apparatus 10 with the reusable cleaning cloth or swifter 500 as previously discussed.

Referring again to FIG. 6, the first locking clasp 24 also comprises of first edge 80, a first frictional locking tooth 82 and a second frictional locking tooth 84. The interior side 85 of the first hinge locking clasp 24 is configured with a short internal hinge wall 86 that is designed to extend substantially into the locking clasp well 36 with the depth of the wall 86 tapering off towards the first edge 80 of the first hinge locking clasp 24 in order to accommodate the thickness of a reusable or disposable cloth. The first hinge locking clasp 24 is rotatably fixed within the locking clasp well 36 by an underside attachment member 88 which encircles a well bar 90 so that the first locking clasp 24 may be rotatably lifted up or down as shown in FIG. 6. Similarly the second locking hinge 28 comprises a first frictional locking tooth 94 and a second frictional locking tooth (not visible) for securing a reusable or disposable cloth in place within the second hinge well 38.

Figure 8:
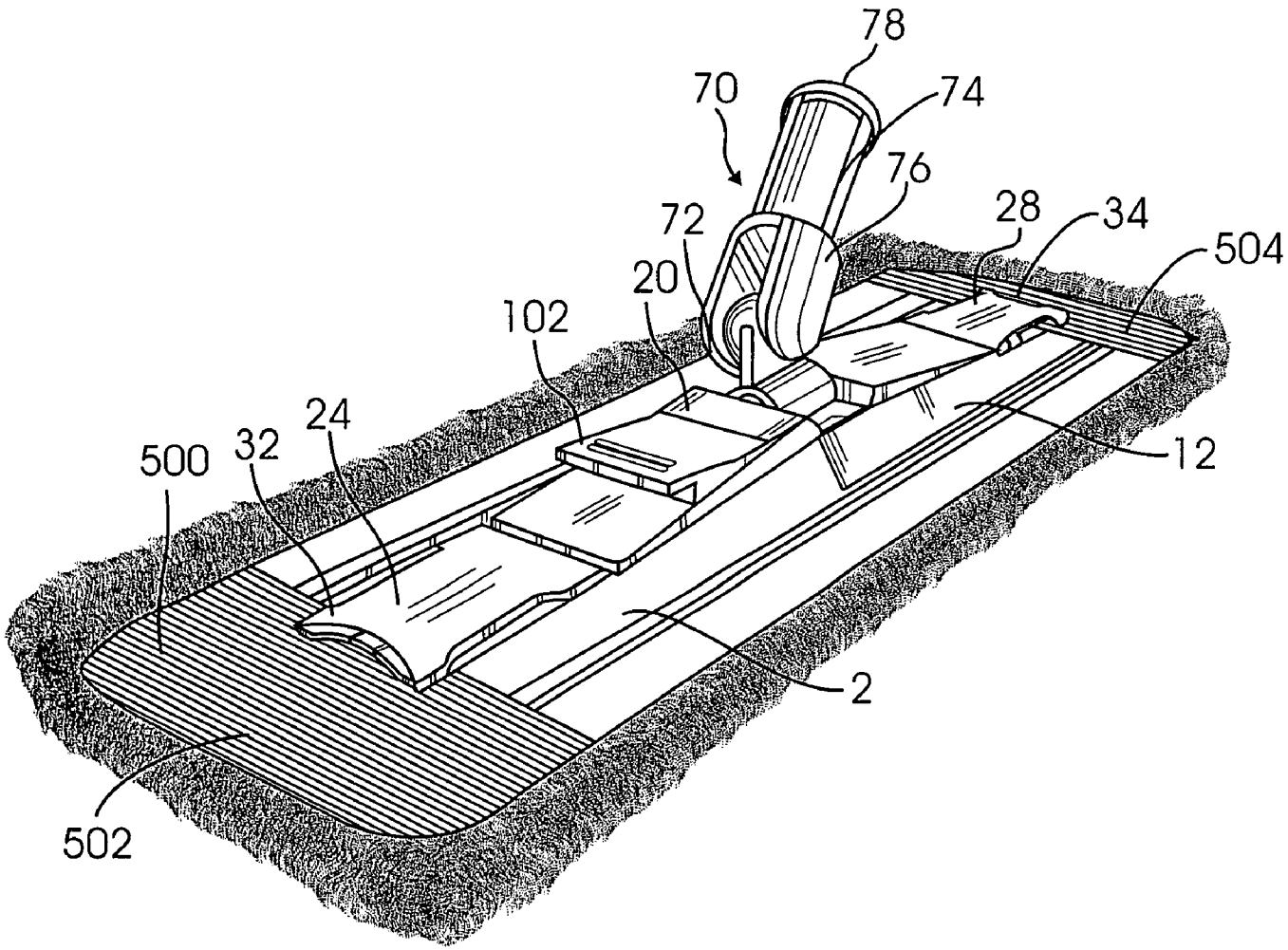
FIG. 8 is a perspective view of a reusable cleaning swifter mop retained in an alternative manner on the present invention multipurpose cleaning apparatus.

In addition to just retaining the respective edges of the first base portion 2 and second base portion 12 in respective pockets 542 and 552 of the reusable cloth or swifter, as illustrated in FIG. 5, the top of retaining member 540 can be placed into first clasping well 36 and further retained by first locking clasp 24 and its teeth 82 and 84 and the top of retaining member 550 can be placed into second clasping well 38 and retained by second locking clasp 28 and its two teeth of which one tooth 94 is shown, as illustrated in FIG. 8. This provides for a more secure attachment which facilitates more vigorous scrubbing with the reusable cleaning cloth or swifter 500.

Figure 9:
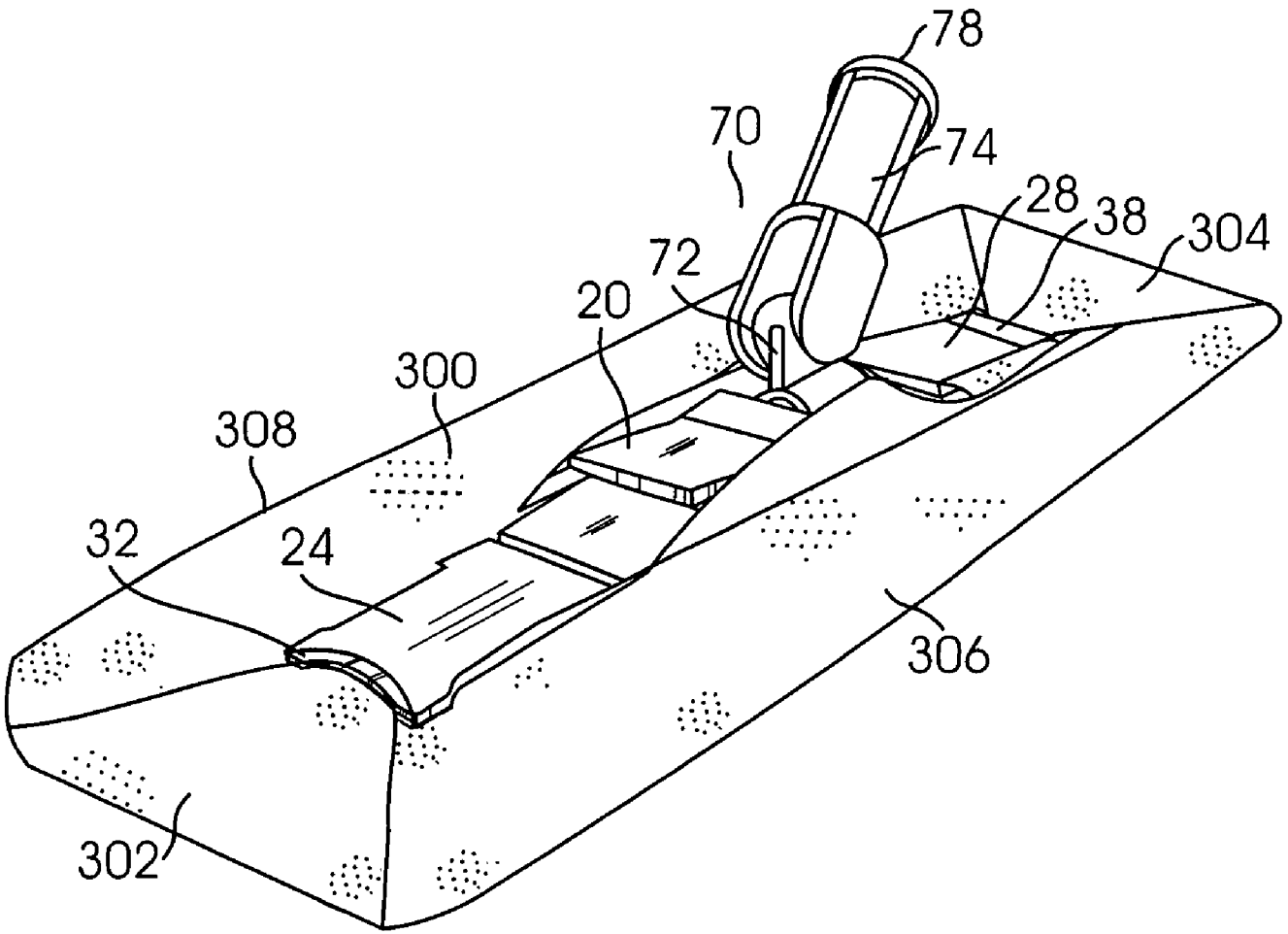
FIG. 9 is a perspective view of a disposable cleaning cloth retained in the alternative manner on the present invention multipurpose cleaning apparatus.

Another use of the present invention multifunction cleaning apparatus is for use with a disposable cloth 300. The function is to firmly retain a disposable cloth for vigorous cleaning and thereafter remove the cloth and discard it and replace it with another cloth. The multifunction cleaning apparatus 10 has its two portions 2 and 12 locked together as illustrated in FIG. 1. Then, as illustrated in FIG. 9, the disposable cloth 300 is wrapped around the bottom of first base portion 2 and second base portion 12 and then covers the tops of both base portions so that one end 302 and a portion of both lengthwise sides 306 and 308 of the disposable cloth 300 are placed within first locking well 36 and retained by rotating first locking clasp 24 over the disposable cloth 300 so that the teeth 82 and 84 retain these sections of the disposable cloth 300 inside first locking well 36. Similarly the second end 304 of the disposable cloth 300 and portions of the opposite lengthwise sides 306 and 308 of the disposable cloth 300 are placed in second locking well 38 and retained by rotating second locking clasp 28 over these sections of cloth 300 so that its teeth retain these sections of the cloth inside second locking well 38.

The combination of the first locking clasp 24 and second locking clasp 28 inhibit the disposable cloth 300 from bunching up along the bottom surface of the multipurpose cleaning apparatus 10 during use and further from sliding off of the multipurpose cleaning apparatus 10. The first locking clasp 24 first and its locking teeth 82 and 84 frictionally fit within the first locking well 36 when the disposable cloth 300 is placed between the underside of the first locking clasp 24 and within the first locking well 36 such that the cloth 300 is largely held in place when the multipurpose cleaning apparatus 10 is in use. The second locking clasp 28 retains another portion of the disposable cloth 300 within second locking well 38 in the same manner. The disposable cloth 300 can be made of rugged paper or a synthetic material.

A third function of the present invention multipurpose cleaning apparatus 10 is to removably retain a cleaning brush or scouring pad.

Referring to FIGS. 1, 7, 10 and 11, the multipurpose cleaning apparatus 10 may optionally be configured with internal side wells 54 and 56 in order to snap detachably attachable first side bar 600 and second side bar 602. The first side bar 600 is comprised of a bottom portion 604, an outward facing side wall 606 and an inward facing side wall 608 that extends the entire width of the first internal channel 54, and a top portion 610. The bottom portion 604 of the first side bar 600 has a internal lip facing portion 612 and a bottom wall 614 that is equipped with a fastening mechanism such as a Velcro strip 616 (See FIGS. 7 and 10). Similarly the second side bar 602 is comprised of a bottom portion 618, a top portion 622, an outward facing side wall 620 and inward facing side wall 624 that also extends the entire width of the second internal channel 56. The bottom portion 618 of the second side bar 602 has a internal lip facing portion 625 and a bottom wall 626 that is also equipped with a fastening means such as a Velcro strip 628 (See FIGS. 7 and 10).

The first base portion 2 first longitudinal side 14 and second base portion 12 first longitudinal side 22 come together to form a first side rail 54. The first base portion 2 second longitudinal side 16 and second base portion 12 second longitudinal side 18 come together to form second side rail 56. Side rail 54 has a recessed upper surface 64 and side rail 56 has a recessed upper surface 62. First side bar 600 is slid onto first side rail 54 and retained thereon by a press fit grip and second side bar 602 is slid onto second side rail 56 and retained thereon by a press fit grip. The velcro attachment surface 616 of first side bar 600 and velcro attachment surface 628 of second side bar 602 extend downwardly as illustrated in FIGS. 7 and 13.

Figure 12:
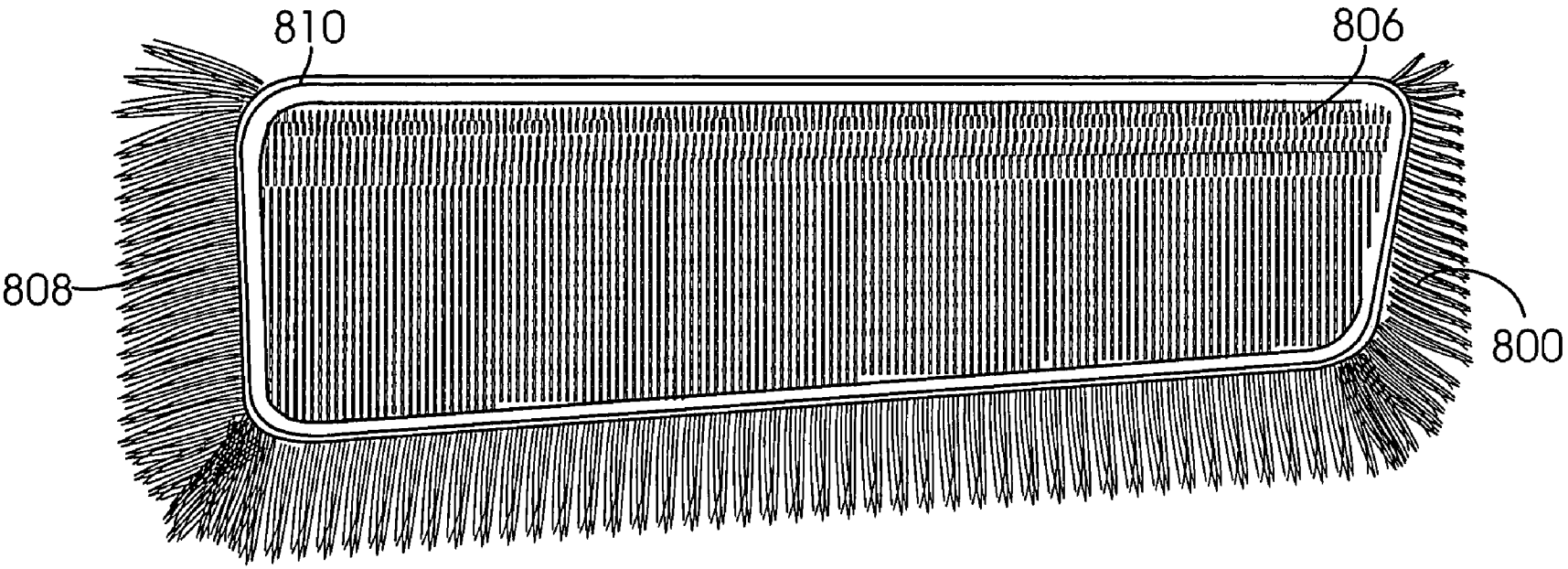
FIG. 12 is a top perspective view of a brush attachment used with the present invention multipurpose cleaning apparatus.

Referring to FIG. 12, the brush attachment 800 used with the present invention multipurpose cleaning apparatus 10 has a top surface 810 having a multiplicity of mating attachment members 806 such as Velcro. The bottom of the attachment 800 has a multiplicity of brushes 808. As illustrated in FIG. 13, the top surface 810 of the brush attachment 800 is press fitted against the mating attachment members 616 and 628 which are mating velcro attachments on the first and second side bars 600 and 602 so that the brush is removably but firmly retained onto the multipurpose cleaning tool so that the multipurpose cleaning tool can be used as a brush cleaner.

Figure 13:
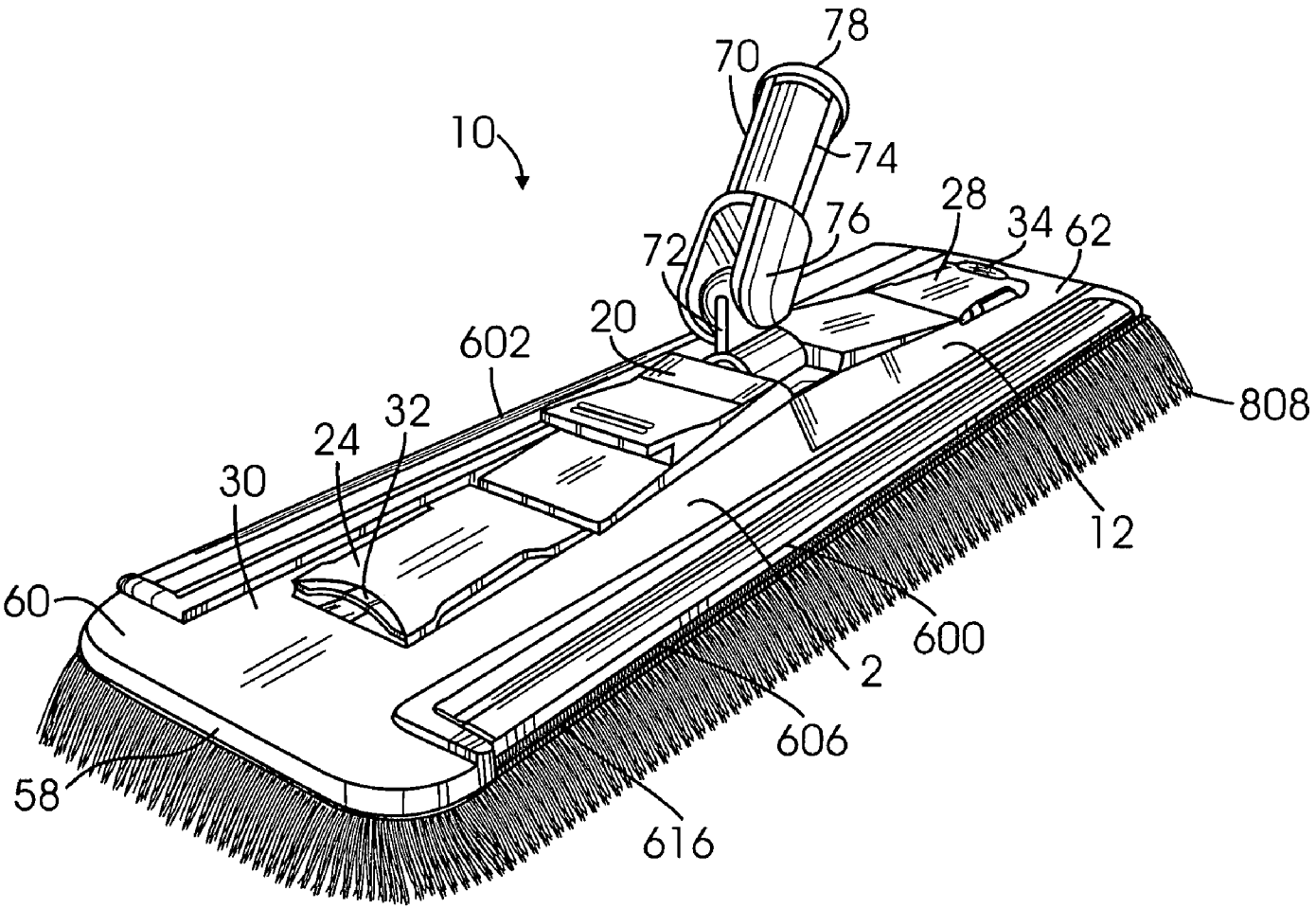
FIG. 13 is a perspective view of the present invention multipurpose cleaning apparatus with the brush attachment in the attached condition.

Referring to FIG. 13, there is illustrated the assembled four-in-one multipurpose cleaning apparatus 10 complete with the first side bar 600 and second side bar 602 engaged to the apparatus 10. The first side bar 600 and second side bar 602 top surfaces 610 and 622 are shown as being level with the top lips 60 and 62. The bottom velcro strips 616 and 628 extend below the bottom internal well walls 802 and 804 (See FIG. 7). This allows the brush component 800 top surface 806 which is configured to removably attach to the velcro strips 618 and 628 to fully engage. The bottom portion 806 of the attachment 800 is completely covered with brush needles 808 in order to enable a user to sweep the floor.

Figure 14:
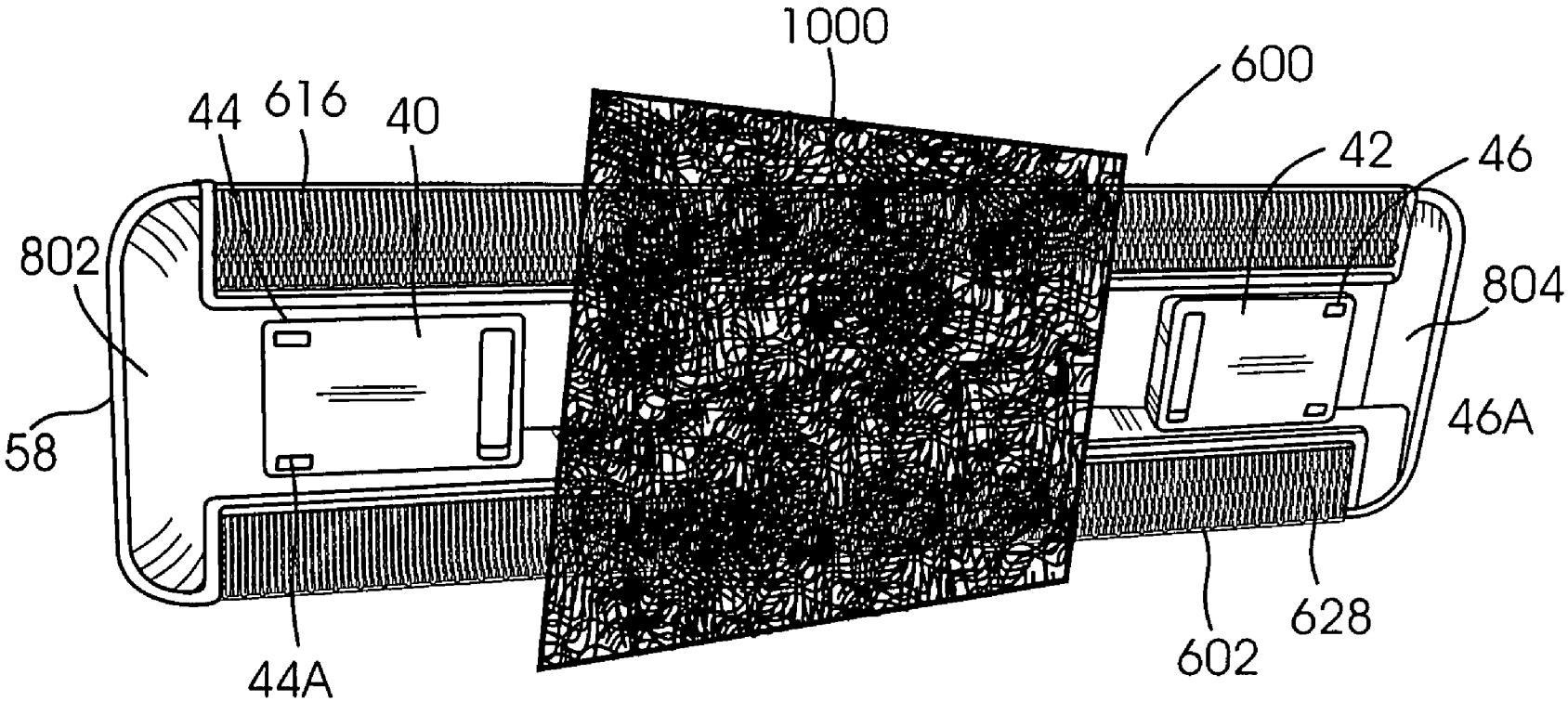
FIG. 14 is a perspective view of the present invention multipurpose cleaning apparatus with a scrubber attachment in the attached condition.

Referring to FIG. 14, a scouring pad which has rough fibrous surfaces is also removably retained onto the mating fastening members such as Velcro fasteners 616 and 628 on the bottom of side bars 600 and 602 so that the multipurpose cleaning apparatus 10 can be used as a scrubbing device with the scrubbing pad 1000 used to scrub a surface such as linoleum or tile. The scrubber brush attachment 1000 may cover a small portion of the underside of the cleaning apparatus 10.

Figure 10:
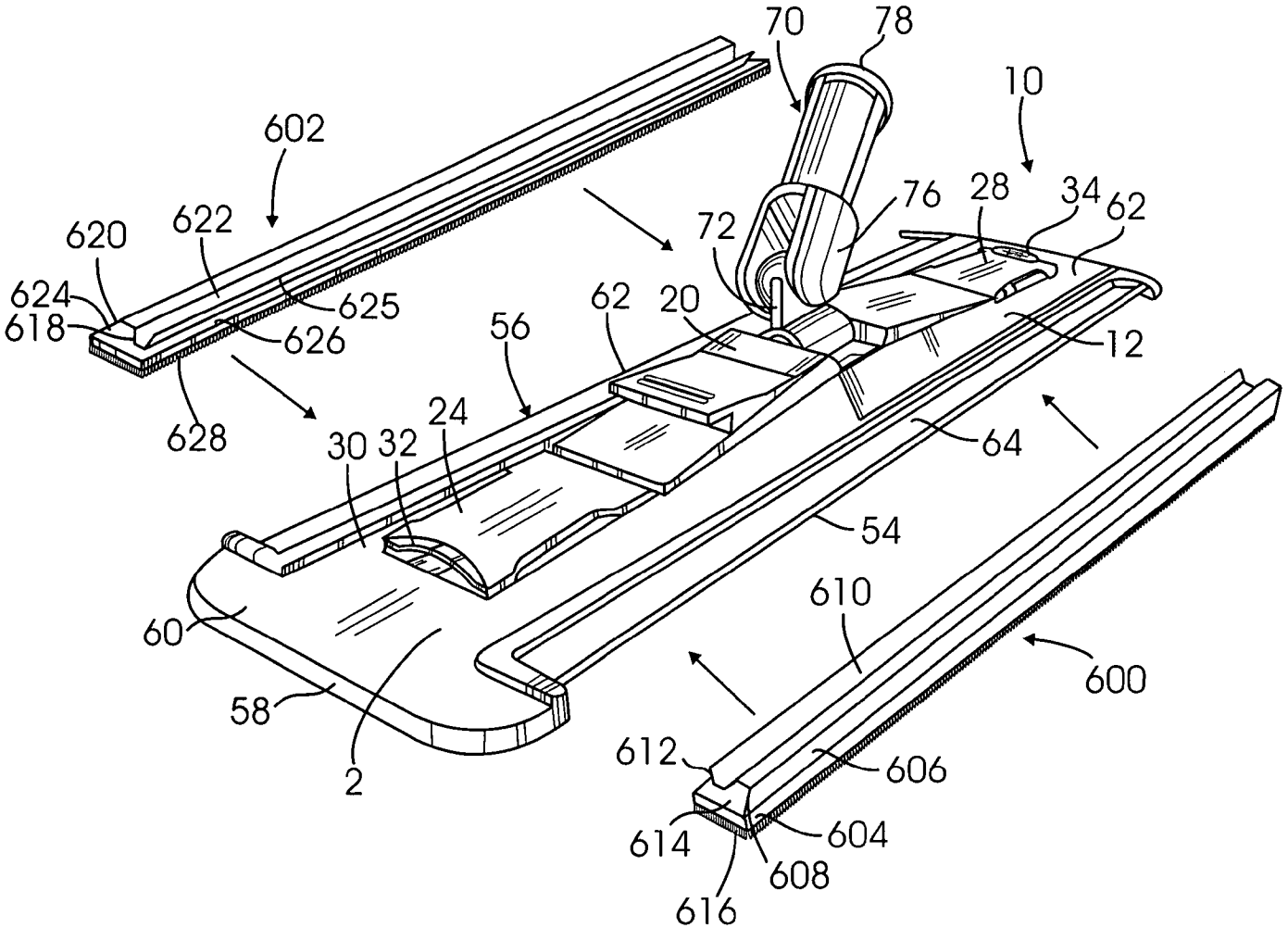
FIG. 10 is an exploded perspective view of the present invention multipurpose cleaning apparatus showing an accessory attachment in the detached condition.
Figure 11:
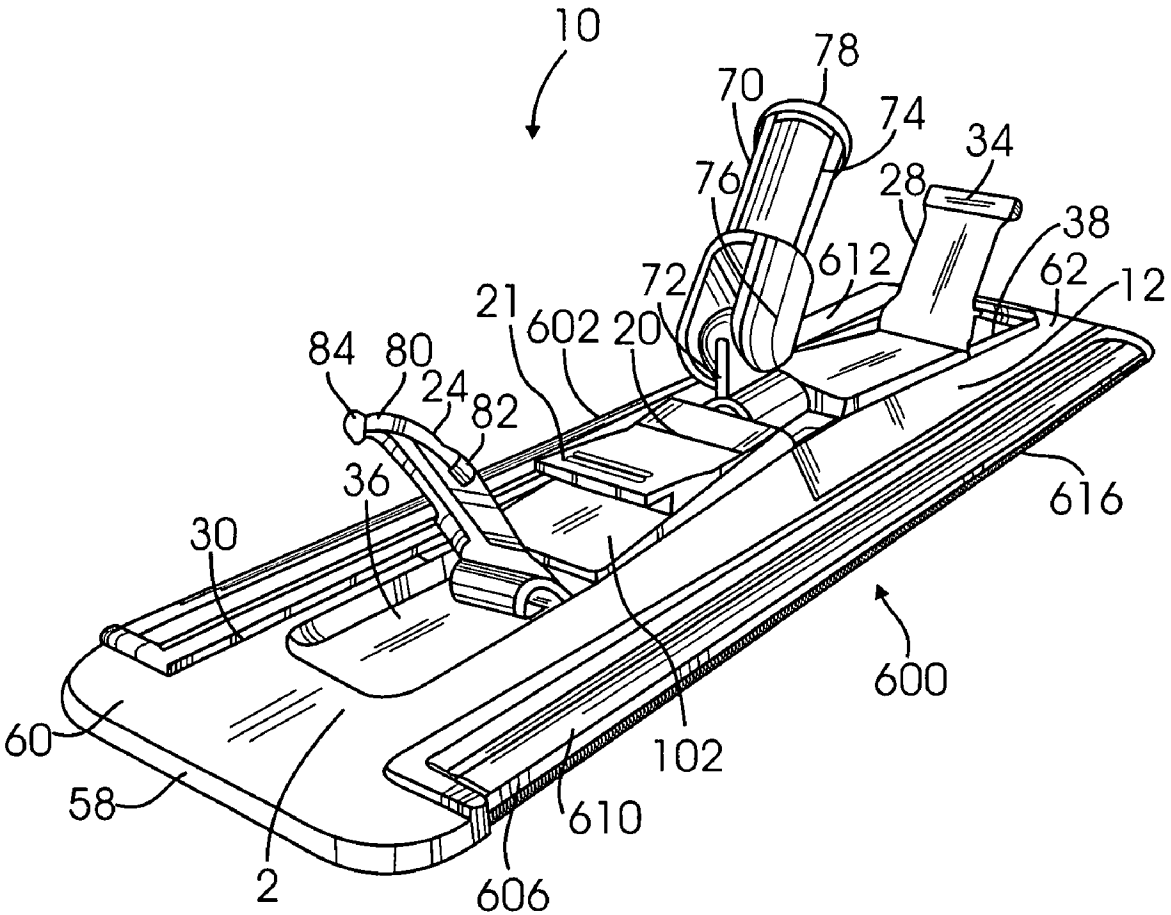
FIG. 11 is a perspective view of the present invention multipurpose cleaning apparatus showing an accessory attachment in the attached condition and the clamping apparatus in the opened condition.

Therefore, the first and second side bars 600 and 602 when attached to the multipurpose cleaning tool 10 enable a user to attach a variety of cleaning attachments such as a brush 800 (See FIGS. 12 and 13) or scrubbing pad 1000 attachment (See FIG. 10).

In the preferred embodiment, the multipurpose cleaning device 10 is a four-in-one cleaning device 10 equipped with a collapsible hinge 52 between a first portion 2 and second portion 12 for easily attaching and removing a brush attachment 500, an engaging clasp 20 for securing the two portions 2 and 12 together, internal side rails 54 and 56 in order to detachably snap first side bar 600 and second side bar 602 that are configured with an attachment means such as velcro strips 616 and 628 for securing brushes 800 and scrubbing pads 1000, and a first base portion 2 and second base portion 12 equipped with a first hinge locking clasp 24 and a second hinge locking clasp 28 respectively for securing disposable cleaning items such as a cleaning cloth 300 and reusable swifter mop pad 500.

While the preferred embodiment is a four-in-one cleaning device, it is apparent to one having ordinary skill in the art that the novel features of this device may be used in any combination in order to accommodate all or some of the above mentioned features. In an alternative embodiment, the base may be one continuous piece whereby the base first portion 2 and second portion 12 are fused together or are manufactured as one solid base.

The multipurpose cleaning tool is preferably molded out of plastic or resin type material.

Defined in detail, the present invention is a multipurpose cleaning apparatus, comprising: (a) a first base portion having a first side and a second side, a transverse exterior edge and a transverse interior edge, and a second base portion having a first side and a second side, a transverse exterior edge and a transverse interior edge, the first and second base portions hingeably connected at the location of their respective interior transverse edges so that they can be locked together to form an elongated structure and can be unlocked to be rotated at an angle relative to each other, and when locked together, their respective first sides form a first elongated ridge and their second sides form a parallel oppositely disposed second elongated ridge; (b) the first base portion having a top surface and bottom surface and the second base portion having a top surface and bottom surface, a handle retaining means rotatably affixed to one of the top surfaces, one interior transverse edge of one of the base portions having an interior tongue and the top surface of the other base portion having an engaging clasp to lock onto the tongue to lock the two base portions at their opposite transverse interior edges and rotatable to unlock the two base portions; (c) a reusable cleaning swifter having a lower cleaning surface and an upper surface with a first receiving pocket at a first end and a second receiving pocket at its oppositely disposed second end, the two base portions rotatable to be at an angle relative to each other so that the first transverse exterior edge of the first base portion is inserted into the first receiving pocket and the second transverse exterior edge of the second base portion is inserted into the second receiving pocket and the two base portions are thereafter rotated to be locked into its elongated position to thereby retain the reusable swifter thereon with the lower cleaning surface of the swifter positioned in an operational condition to clean a surface; (d) the top surface of the first base portion having a well which receives a rotatable locking clasp which rotatably opens so that an open end of the rotatable locking clasp faces the transverse exterior end of the first base portion and the top surface of the second base portion having a well which receives a rotatable locking clasp which rotatably opens so that an open end of the rotatable locking clasp faces the transverse exterior end of the second base portion, the first pocket of the reusable swifter being of sufficient length to extend into the well of the first base portion and the locking clasp rotatable to the closed position to grip the top of the first pocket and the second pocket of the reusable swifter being of sufficient length to extend into the well of the second base portion and the locking clasp rotatable to the closed position to grip the top of the second pocket; (e) a disposable cloth having a body including a first side, a second side, a first end and a second end, and after the reusable cleaning swifter is removed from the first and second base portion, the disposable cleaning cloth is wrapped about the first and second base portions after they are in the elongated locked condition, and the first end and a portion of each sides of the disposable cleaning cloth is placed into the well of the first base portion and retained therein by the locking clasp and the second end and a portion of the first and second sides are inserted into the well of the second base portion and retained therein by the locking clasp so that the disposable cleaning cloth is oriented in a cleaning position; (f) a first elongated side bar having an elongated receiving channel and a bottom wall supporting gripping means and a second elongated side bar having an elongated receiving channel and a bottom wall supporting gripping means, and after the disposable cleaning cloth is removed from the first and second base portions and the base portions are in their locked elongated condition, the first elongated side bar is placed onto the first elongated ridge through its elongated channel and gripped thereon and the second elongated side bar is placed onto the second elongated ridge through its elongated channel and gripped thereon so that the respective gripping means are adjacent the bottom surfaces of the base portions; (g) a brush member having a body with a top surface having gripping means thereon and a multiplicity of brushes extending from the body, the gripping means on the body attached to the gripping means on the first and second elongated side bars so that the brushes extend from the first and second base portions in a cleaning orientation; and (h) a scrubbing pad having fibrous surfaces, and after the brush member is removed from the base portions, the scrubbing pad is retained on the two base portions by the two gripping means on the elongated side bars.

Defined broadly, the present invention is a multipurpose cleaning apparatus, comprising: (a) a first base portion having a first side and a second side, a transverse exterior edge and a transverse interior edge, and a second base portion having a first side and a second side, a transverse exterior edge and a transverse interior edge, the first and second base portions hingeably connected at the location of their respective interior transverse edges by locking means so that they can be locked together to form an elongated structure and can be unlocked to be rotated at an angle relative to each other, and when locked together, their respective first sides form a first elongated ridge and their second sides form a parallel oppositely disposed second elongated ridge; (b) the first base portion having a top surface and bottom surface and the second base portion having a top surface and bottom surface, a handle retaining means rotatably affixed to one of the top surfaces; (c) a reusable cleaning swifter having a lower cleaning surface and an upper surface with a first receiving pocket at a first end and a second receiving pocket at its oppositely disposed second end, the two base portions rotatable to be at an angle relative to each other so that the first transverse exterior edge of the first base portion is inserted into the first receiving pocket and the second transverse exterior edge of the second base portion is inserted into the second receiving pocket and the two base portions are thereafter rotated to be locked into its elongated position to thereby retain the reusable swifter thereon with the lower cleaning surface of the swifter positioned in an operational condition to clean a surface; (d) the top surface of the first base portion having a well which receives a rotatable locking clasp which rotatably opens so that an open end of the rotatable locking clasp faces the transverse exterior end of the first base portion and the top surface of the second base portion having a well which receives a rotatable locking clasp which rotatably opens so that an open end of the rotatable locking clasp faces the transverse exterior end of the second base portion, the first pocket of the reusable swifter being of sufficient length to extend into the well of the first portion and the locking clasp rotatable to the closed position to grip the top of the first pocket and the second pocket of the reusable swifter being of sufficient length to extend into the well of the second portion and the locking clasp rotatable to the closed position to grip the top of the second pocket; (e) a disposable cloth having a body including a first side, a second side, a first end and a second end, and after the reusable cleaning swifter is removed from the first and second base portion, the disposable cleaning cloth is wrapped about the first and second base portions after they are in the elongated locked condition, and the first end and a portion of each sides of the disposable cleaning cloth is placed into the well of the first base portion and retained therein by the locking clasp and the second end and a portion of the first and second sides are inserted into the well of the second base portion and retained therein by the locking clasp so that the disposable cleaning cloth is oriented in a cleaning position; (f) a first elongated side bar having an elongated receiving channel and a bottom wall supporting gripping means and a second elongated side bar having an elongated receiving channel and a bottom wall supporting gripping means, and after the disposable cleaning cloth is removed from the first and second base portions and the base portions are in their locked elongated condition, the first elongated side bar is placed onto the first elongated ridge through its elongated channel and gripped thereon and the second elongated side bar is placed onto the second elongated ridge through its elongated channel and gripped thereon so that the respective gripping means are adjacent the bottom surfaces of the base portions; (g) a brush member having a body with a top surface having gripping means thereon and a multiplicity of brushes extending from the body, the gripping means on the body attached to the gripping means on the first and second elongated side bars so that the brushes extend from the first and second base portions in a cleaning orientation; and (h) a scrubbing pad having fibrous surfaces, and after the brush member is removed from the base portions, the scrubbing pad is retained on the two base portions by the two gripping means on the elongated side bars.

Defined more broadly, the present invention is a multipurpose cleaning apparatus, comprising: (a) a first base portion having a first side and a second side, a transverse exterior edge and a transverse interior edge, and a second base portion having a first side and a second side, a transverse exterior edge and a transverse interior edge, the first and second base portions hingeably connected at the location of their respective interior transverse edges by locking means so that they can be locked together to form an elongated structure and can be unlocked to be rotated at an angle relative to each other, and when locked together, their respective first sides form a first elongated ridge and their second sides form a parallel oppositely disposed second elongated ridge; (b) the first base portion having a top surface and bottom surface and the second base portion having a top surface and bottom surface, a handle retaining means affixed to one of the top surfaces, (c) a reusable cleaning swifter having a lower cleaning surface and an upper surface with a first receiving pocket at a first end and a second receiving pocket at its oppositely disposed second end, the two base portions rotatable to be at an angle relative to each other so that the first transverse exterior edge of the first base portion is inserted into the first receiving pocket and the second transverse exterior edge of the second base portion is inserted into the second receiving pocket and the two base portions are thereafter rotated to be locked into its elongated position to thereby retain the reusable swifter thereon with the lower cleaning surface of the swifter positioned in an operational condition to clean a surface; (d) the top surface of the first base portion having a well which receives a rotatable locking clasp which rotatably opens so that an open end of the rotatable locking clasp faces the transverse exterior end of the first base portion and the top surface of the second base portion having a well which receives a rotatable locking clasp which rotatably opens so that an open end of the rotatable locking clasp faces the transverse exterior end of the second base portion; (e) a disposable cloth having a body including a first side, a second side, a first end and a second end, and after the reusable cleaning swifter is removed from the first and second base portion, the disposable cleaning cloth is wrapped about the first and second base portions after they are in the elongated locked condition, and the first end and a portion of each sides of the disposable cleaning cloth is placed into the well of the first base portion and retained therein by the locking clasp and the second end and a portion of the first and second sides are inserted into the well of the second base portion and retained therein by the locking clasp so that the disposable cleaning cloth is oriented in a cleaning position; (f) a first elongated side bar having an elongated receiving channel and a bottom wall supporting gripping means and a second elongated side bar having an elongated receiving channel and a bottom wall supporting gripping means, and after the disposable cleaning cloth is removed from the first and second base portions and the base portions are in their locked elongated condition, the first elongated side bar is placed onto the first elongated ridge through its elongated channel and gripped thereon and the second elongated side bar is placed onto the second elongated ridge through its elongated channel and gripped thereon so that the respective gripping means are adjacent the bottom surfaces of the base portions; (g) a brush member having a body with a top surface having gripping means thereon and a multiplicity of brushes extending from the body, the gripping means on the body attached to the gripping means on the first and second elongated side bars so that the brushes extend from the first and second base portions in a cleaning orientation; and (h) a scrubbing pad having fibrous surfaces, and after the brush member is removed from the base portions, the scrubbing pad is retained on the two base portions by the two gripping means on the elongated side bars.

Defined even more broadly, the present invention is a multipurpose cleaning apparatus, comprising: (a) a base portion having two sections which are rotatably connected so that the two sections are rotatable to an angle relative to each other when disconnected and locked to an elongated structure when connected, the base portion having two opposite transverse ends and two parallel oppositely disposed sides; (b) the two sections of the base portion each having a top surface and bottom surface, a handle retaining means affixed to the top surface of at least one second; (c) a reusable cleaning swifter having a lower cleaning surface and an upper surface with a first receiving means and a second receiving means, the base portion rotated to its detached condition so that a respective transverse end of each section is respectively inserted into a respective receiving means on the reusable cleaning swifter, the sections thereafter rotated so that the base is in its elongated position to thereby retain the reusable swifter thereon with the lower cleaning surface of the swifter positioned in an operational condition to clean a surface; (d) the top surface of each section of the base portion having receiving means which receives a locking means which opens so that an open end of the locking means faces a transverse end of that section; (e) a disposable cleaning cloth having a body including a first side, a second side, a first end and a second end, and after the reusable cleaning swifter is removed from the sections of the base portion, the disposable cleaning cloth is wrapped about the two sections of the base portion after the sections are in the elongated locked condition, and the first end and a portion of each sides of the disposable cleaning cloth is placed into the receiving means of the first section and retained therein by the locking means and the second end and a portion of the first and second sides are inserted into the receiving means of the second section and retained therein by the locking means so that the disposable cleaning cloth is oriented in a cleaning position; (f) a first elongated side bar having an elongated receiving channel and a bottom wall supporting gripping means and a second elongated side bar having an elongated receiving channel and a bottom wall supporting gripping means, and after the disposable cleaning cloth is removed from the first and second section of the base portion and the sections are in their locked elongated condition, the first elongated side bar is placed onto a first side through its elongated channel and gripped thereon and the second elongated side bar is placed onto the second side through its elongated channel and gripped thereon so that the respective gripping means are adjacent the bottom surfaces of the base portions; (g) a brush member having a body with a top surface having gripping means thereon and a multiplicity of brushes extending from the body, the gripping means on the body attached to the gripping means on the first and second elongated side bars so that the brushes extend from the first and second base portions in a cleaning orientation; and (h) a scrubbing pad having fibrous surfaces, and after the brush member is removed from the base portions, the scrubbing pad is retained on the two seconds of the base portion by the two gripping means on the elongated side bars.

Defined even more broadly, the present invention is a multipurpose cleaning apparatus, comprising: (a) a base portion having two sections which are rotatably connected so that the two sections are rotatable to an angle relative to each other when disconnected and locked to an elongated structure when connected, the base portion having two opposite transverse ends and two parallel oppositely disposed sides; (b) the two sections of the base portion each having a top surface and bottom surface, a handle retaining means affixed to the top surface of at least one second; (c) a reusable cleaning swifter having a lower cleaning surface and receiving means, the base portion rotated to its detached condition so that a respective transverse end of each section is respectively inserted into the receiving means on the reusable cleaning swifter, the sections thereafter rotated so that the base is in its elongated position to thereby retain the reusable swifter thereon with the lower cleaning surface of the swifter positioned in an operational condition to clean a surface; (d) the top surface of each section of the base portion having receiving means which receives a locking means which opens so that an open end of the locking means faces a transverse end of that section; (e) a disposable cleaning cloth having a body including a first side, a second side, a first end and a second end, and after the reusable cleaning swifter is removed from the sections of the base portion, the disposable cleaning cloth is retained about the two sections of the base portion after the sections are in the elongated locked condition, and the first end and a portion of each sides of the disposable cleaning cloth is placed into the receiving means of the first section and retained therein by the locking means and the second end and a portion of the first and second sides are inserted into the receiving means of the second section and retained therein by the locking means so that the disposable cleaning cloth is oriented in a cleaning position; (f) a first elongated side bar having an elongated receiving channel and a bottom wall supporting gripping means and a second elongated side bar having an elongated receiving channel and a bottom wall supporting gripping means, and after the disposable cleaning cloth is removed from the first and second sections of the base portion and the sections are in their locked elongated condition, the first elongated side bar is placed onto a first side through its elongated channel and gripped thereon and the second elongated side bar is placed onto the second side through its elongated channel and gripped thereon so that the respective gripping means are adjacent the bottom surfaces of the base portions; (g) a brush member having a body with a top surface having gripping means thereon and a multiplicity of brushes extending from the body, the gripping means on the body attached to the gripping means on the first and second elongated side bars so that the brushes extend from the first and second base portions in a cleaning orientation; and (h) a scrubbing pad having fibrous surfaces, and after the brush member is removed from the base portions, the scrubbing pad is retained on the two seconds of the base portion by the two gripping means on the elongated side bars.

Defined even more broadly, the present invention is a multipurpose cleaning apparatus, comprising: (a) a base portion having two sections which are rotatably connected so that the two sections are rotatable to an angle relative to each other when disconnected and locked to an elongated structure when connected, the base portion having two opposite transverse ends and two parallel oppositely disposed sides; (b) the two sections of the base portion each having a top surface and bottom surface, a handle retaining means affixed to the top surface of at least one second; (c) a reusable cleaning swifter having a lower cleaning surface and receiving means, the base portion rotated to its detached condition so that a respective transverse end of each section is respectively inserted into a receiving means on the reusable cleaning swifter, the sections thereafter rotated so that the base is in its elongated position to thereby retain the reusable swifter thereon with the lower cleaning surface of the swifter positioned in an operational condition to clean a surface; (d) the top surface of each section of the base portion having receiving means which receives a locking means which opens so that an open end of the locking means faces a transverse end of that section; and (e) a disposable cleaning cloth having a body including a first side, a second side, a first end and a second end, and after the reusable cleaning swifter is removed from the sections of the base portion, the disposable cleaning cloth is wrapped about the two sections of the base portion after the sections are in the elongated locked condition, and the first end and a portion of each sides of the disposable cleaning cloth is placed into the receiving means of the first section and retained therein by the locking means and the second end and a portion of the first and second sides are inserted into the receiving means of the second section and retained therein by the locking means so that the disposable cleaning cloth is oriented in a cleaning position.

Defined even more broadly, the present invention is a multipurpose cleaning apparatus, comprising: (a) a base portion having two parallel oppositely disposed sides, a top having means for retaining a handle, and a bottom surface; (b) a first elongated side bar having an elongated receiving channel and a bottom wall supporting gripping means and a second elongated side bar having an elongated receiving channel and a bottom wall supporting gripping means, the first elongated side bar is placed onto a first side through its elongated channel and gripped thereon and the second elongated side bar is placed onto the second side through its elongated channel and gripped thereon so that the respective gripping means are adjacent the bottom surfaces of the base portions; and (c) a brush member having a body with a top surface having gripping means thereon and a multiplicity of brushes extending from the body, the gripping means on the body attached to the gripping means on the first and second elongated side bars so that the brushes extend from the first and second base portions in a cleaning orientation.

Defined even more broadly, the present invention is a multipurpose cleaning apparatus, comprising: (a) a base portion having two sections which are rotatably connected so that the two sections are rotatable to an angle relative to each other when disconnected and locked to an elongated structure when connected, the base portion having two opposite transverse ends and two parallel oppositely disposed sides; (b) the two sections of the base portion each having a top surface and bottom surface, a handle retaining means affixed to the top surface of at least one second; (c) a reusable cleaning swifter having a lower cleaning surface and receiving means, the base portion rotated to its detached condition so that a respective transverse end of each section is respectively inserted into a receiving means on the reusable cleaning swifter, the sections thereafter rotated so that the base is in its elongated position to thereby retain the reusable swifter thereon with the lower cleaning surface of the swifter positioned in an operational condition to clean a surface; and (d) the top surface of each section of the base portion having receiving means which receives a locking means which opens so that an open end of the locking means faces a transverse end of that section, the receiving means of the reusable cleaning swifter being of sufficient length to extend into the receiving means of each section and the locking means on the base grips the receiving means of the reusable swifter to more securely retain the removable swifter on the base.

Defined even more broadly, the present invention is a multipurpose cleaning apparatus, comprising: (a) a base portion having two sections which are locked to an elongated structure when connected, the base portion having two opposite transverse ends and two parallel oppositely disposed sides; (b) the two sections of the base portion each having a top surface and bottom surface, a handle retaining means affixed to the top surface of at least one second; (c) the top surface of each section of the base portion having receiving means which receives a locking means which opens so that an open end of the locking means faces a transverse end of that section; and (d) a disposable cleaning cloth having a body including a first side, a second side, a first end and a second end, the disposable cleaning cloth is wrapped about the two sections of the base portion after the sections are in the elongated locked condition, and the first end and a portion of each sides of the disposable cleaning cloth is placed into the receiving means of the first section and retained therein by the locking means and the second end and a portion of the first and second sides are inserted into the receiving means of the second section and retained therein by the locking means so that the disposable cleaning cloth is oriented in a cleaning position.

Defined even more broadly, the present invention is a four-in-one multipurpose cleaning tool comprising: (a) a base portion comprised of first base portion and a second base portion wherein each base portion is comprised of a top surface, a bottom surface, a second side edge, a first side edge, a first edge, and a second edge; (b) a handle member for retaining a handle comprised of a handle retaining portion moveably attached to said second base portion; (c) a first portion well housing within the top surface of said first base portion where said first portion well housing further comprises a well bar for retaining a moveable first hinge locking clasp wherein the locking clasp is comprised of a first and second locking tooth for frictionally fitted within said well; (d) a second portion well housing within the top surface of said second base portion where said second portion well housing further comprises a well bar for retaining a moveable second hinge locking clasp wherein the locking clasp is comprised of a first and second locking tooth for frictionally fitting within said well; (e) a first internal side well within said first edge wherein the first internal side well is comprised of a first internal lip wherein said lip is horizontally and centrally positioned within the well; (f) a detachably attachable first side bar comprised of a second edge, and a top surface, and a bottom portion wherein said bottom portion is configured with a velcro strip, and where said bar is configured to accept said first internal lip of said first internal well; (g) a second internal side well within said second edge wherein the second internal side well is comprised of a second internal lip and wherein said lip is horizontally and centrally positioned within the well; and (h) a detachably attachable second side bar comprised of a second edge, and a top surface, and a bottom portion wherein said bottom portion is configured with a velcro strip, and where said bar is configured to accept said second internal lip of said second internal well.

Defined even more broadly, the present invention is a multipurpose cleaning apparatus comprising: (a) a base portion comprised of first base portion and a second base portion wherein each base portion is comprised of a top surface, a bottom surface, a second side edge, a first side edge, a first edge, and a second edge; (b) a handle member for retaining a handle comprised of a handle retaining portion moveably attached to said second base portion; (c) a first portion well housing within the top surface of said first base portion where said first portion well housing further comprises a well bar for retaining a moveable first hinge locking clasp wherein the locking clasp is comprised of a first and second locking tooth for frictionally fitted within said well; and (d) a second portion well housing within the top surface of said second base portion where said second portion well housing further comprises a well bar for retaining a moveable second hinge locking clasp wherein the locking clasp is comprised of a first and second locking tooth for frictionally fitting within said well.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A multipurpose cleaning apparatus, comprising:

a. a first base portion having a first side and a second side, a transverse exterior edge and a transverse interior edge, and a second base portion having a first side and a second side, a transverse exterior edge and a transverse interior edge, the first and second base portions hingeably connected at the location of their respective interior transverse edges so that they can be locked together to form an elongated structure and can be unlocked to be rotated at an angle relative to each other, and when locked together, their respective first sides form a first elongated ridge and their second sides form a parallel oppositely disposed second elongated ridge;

b. the first base portion having a top surface and bottom surface and the second base portion having a top surface and bottom surface, a handle retaining means rotatably affixed to one of the top surfaces, one interior transverse edge of one of the base portions having an interior tongue and the top surface of the other base portion having an engaging clasp to lock onto the tongue to lock the two base portions at their opposite transverse interior edges and rotatable to unlock the two base portions;

c. a reusable cleaning swifter having a lower cleaning surface and an upper surface with a first receiving pocket at a first end and a second receiving pocket at its oppositely disposed second end, the two base portions rotatable to be at an angle relative to each other so that the first transverse exterior edge of the first base portion is inserted into the first receiving pocket and the second transverse exterior edge of the second base portion is inserted into the second receiving pocket and the two base portions are thereafter rotated to be locked into its elongated position to thereby retain the reusable swifter thereon with the lower cleaning surface of the swifter positioned in an operational condition to clean a surface;

d. the top surface of the first base portion having a well which receives a rotatable locking clasp which rotatably opens so that an open end of the rotatable locking clasp faces the transverse exterior end of the first base portion and the top surface of the second base portion having a well which receives a rotatable locking clasp which rotatably opens so that an open end of the rotatable locking clasp faces the transverse exterior end of the second base portion, the first pocket of the reusable swifter being of sufficient length to extend into the well of the first base portion and the locking clasp rotatable to the closed position to grip the top of the first pocket and the second pocket of the reusable swifter being of sufficient length to extend into the well of the second base portion and the locking clasp rotatable to the closed position to grip the top of the second pocket;

e. a disposable cloth having a body including a first side, a second side, a first end and a second end, the disposable cleaning cloth is retained about the first and second base portions after they are in the elongated locked condition, and the first end and a portion of each sides of the disposable cleaning cloth is placed into the well of the first base portion and retained therein by the locking clasp and the second end and a portion of the first and second sides are inserted into the well of the second base portion and retained therein by the locking clasp so that the disposable cleaning cloth is oriented in a cleaning position;

f. a first elongated side bar having an elongated receiving channel and a bottom wall supporting gripping means and a second elongated side bar having an elongated receiving channel and a bottom wall supporting gripping means, and after the disposable cleaning cloth is removed from the first and second base portions and the base portions are in their locked elongated condition, the first elongated side bar is placed onto the first elongated ridge through its elongated channel and gripped thereon and the second elongated side bar is placed onto the second elongated ridge through its elongated channel and gripped thereon so that the respective gripping means are adjacent the bottom surfaces of the base portions;

g. a brush member having a body with a top surface having gripping means thereon and a multiplicity of brushes extending from the body, the gripping means on the body attached to the gripping means on the first and second elongated side bars so that the brushes extend from the first and second base portions in a cleaning orientation; and h. a scrubbing pad having fibrous surfaces, and after the brush member is removed from the base portions, the scrubbing pad is retained on the two base portions by the two gripping means on the elongated side bars.

2. A multipurpose cleaning apparatus, comprising:

a. a first base portion having a first side and a second side, a transverse exterior edge and a transverse interior edge, and a second base portion having a first side and a second side, a transverse exterior edge and a transverse interior edge, the first and second base portions hingeably connected at the location of their respective interior transverse edges by locking means so that they can be locked together to form an elongated structure and can be unlocked to be rotated at an angle relative to each other, and when locked together, their respective first sides form a first elongated ridge and their second sides form a parallel oppositely disposed second elongated ridge;

b. the first base portion having a top surface and bottom surface and the second base portion having a top surface and bottom surface, a handle retaining means rotatably affixed to one of the top surfaces;

c. a reusable cleaning swifter having a lower cleaning surface and an upper surface with a first receiving pocket at a first end and a second receiving pocket at its oppositely disposed second end, the two base portions rotatable to be at an angle relative to each other so that the first transverse exterior edge of the first base portion is inserted into the first receiving pocket and the second transverse exterior edge of the second base portion is inserted into the second receiving pocket and the two base portions are thereafter rotated to be locked into its elongated position to thereby retain the reusable swifter thereon with the lower cleaning surface of the swifter positioned in an operational condition to clean a surface;

d. the top surface of the first base portion having a well which receives a rotatable locking clasp which rotatably opens so that an open end of the rotatable locking clasp faces the transverse exterior end of the first base portion and the top surface of the second base portion having a well which receives a rotatable locking clasp which rotatably opens so that an open end of the rotatable locking clasp faces the transverse exterior end of the second base portion, the first pocket of the reusable swifter being of sufficient length to extend into the well of the first portion and the locking clasp rotatable to the closed position to grip the top of the first pocket and the second pocket of the reusable swifter being of sufficient length to extend into the well of the second base portion and the locking clasp rotatable to the closed position to grip the top of the second pocket;

e. a disposable cloth having a body including a first side, a second side, a first end and a second end, the disposable cleaning cloth is retained about the first and second base portions after they are in the elongated locked condition, and the first end and a portion of each sides of the disposable cleaning cloth is placed into the well of the first base portion and retained therein by the locking clasp and the second end and a portion of the first and second sides are inserted into the well of the second base portion and retained therein by the locking clasp so that the disposable cleaning cloth is oriented in a cleaning position;

f. a first elongated side bar having an elongated receiving channel and a bottom wall supporting gripping means and a second elongated side bar having an elongated receiving channel and a bottom wall supporting gripping means, and after the disposable cleaning cloth is removed from the first and second base portions and the base portions are in their locked elongated condition, the first elongated side bar is placed onto the first elongated ridge through its elongated channel and gripped thereon and the second elongated side bar is placed onto the second elongated ridge through its elongated channel and gripped thereon so that the respective gripping means are adjacent the bottom surfaces of the base portions;

g. a brush member having a body with a top surface having gripping means thereon and a multiplicity of brushes extending from the body, the gripping means on the body attached to the gripping means on the first and second elongated side bars so that the brushes extend from the first and second base portions in a cleaning orientation; and h. a scrubbing pad having fibrous surfaces, and after the brush member is removed from the base portions, the scrubbing pad is retained on the two base portions by the two gripping means on the elongated side bars.

3. A multipurpose cleaning apparatus, comprising:

a. a first base portion having a first side and a second side, a transverse exterior edge and a transverse interior edge, and a second base portion having a first side and a second side, a transverse exterior edge and a transverse interior edge, the first and second base portions hingeably connected at the location of their respective interior transverse edges by locking means so that they can be locked together to form an elongated structure and can be unlocked to be rotated at an angle relative to each other, and when locked together, their respective first sides form a first elongated ridge and their second sides form a parallel oppositely disposed second elongated ridge;

b. the first base portion having a top surface and bottom surface and the second base portion having a top surface and bottom surface, a handle retaining means affixed to one of the top surfaces, c. a reusable cleaning swifter having a lower cleaning surface and an upper surface with a first receiving pocket at a first end and a second receiving pocket at its oppositely disposed second end, the two base portions rotatable to be at an angle relative to each other so that the first transverse exterior edge of the first base portion is inserted into the first receiving pocket and the second transverse exterior edge of the second base portion is inserted into the second receiving pocket and the two base portions are thereafter rotated to be locked into its elongated position to thereby retain the reusable swifter thereon with the lower cleaning surface of the swifter positioned in an operational condition to clean a surface;

d. the top surface of the first base portion having a well which receives a rotatable locking clasp which rotatably opens so that an open end of the rotatable locking clasp faces the transverse exterior end of the first base portion and the top surface of the second base portion having a well which receives a rotatable locking clasp which rotatably opens so that an open end of the rotatable locking clasp faces the transverse exterior end of the second base portion;

e. a disposable cloth having a body including a first side, a second side, a first end and a second end, the disposable cleaning cloth is retained about the first and second base portions after they are in the elongated locked condition, and the first end and a portion of each sides of the disposable cleaning cloth is placed into the well of the first base portion and retained therein by the locking clasp and the second end and a portion of the first and second sides are inserted into the well of the second base portion and retained therein by the locking clasp so that the disposable cleaning cloth is oriented in a cleaning position;

f. a first elongated side bar having an elongated receiving channel and a bottom wall supporting gripping means and a second elongated side bar having an elongated receiving channel and a bottom wall supporting gripping means, and after the disposable cleaning cloth is removed from the first and second base portions and the base portions are in their locked elongated condition, the first elongated side bar is placed onto the first elongated ridge through its elongated channel and gripped thereon and the second elongated side bar is placed onto the second elongated ridge through its elongated channel and gripped thereon so that the respective gripping means are adjacent the bottom surfaces of the base portions;

g. a brush member having a body with a top surface having gripping means thereon and a multiplicity of brushes extending from the body, the gripping means on the body attached to the gripping means on the first and second elongated side bars so that the brushes extend from the first and second base portions in a cleaning orientation; and h. a scrubbing pad having fibrous surfaces, and after the brush member is removed from the base portions, the scrubbing pad is retained on the two base portions by the two gripping means on the elongated side bars.

4. A multipurpose cleaning apparatus, comprising:

a. a base portion having two sections which are rotatably connected so that the two sections are rotatable to an angle relative to each other when disconnected and locked to an elongated structure when connected, the base portion having two opposite transverse ends and two parallel oppositely disposed sides;

b. the two sections of the base portion each having a top surface and bottom surface, a handle retaining means affixed to the top surface of at least one of the two sections;

c. a reusable cleaning swifter having a lower cleaning surface and an upper surface with a first receiving means and a second receiving means, the base portion rotated to its detached condition so that a respective transverse end of each section is respectively inserted into a respective receiving means on the reusable cleaning swifter, the sections thereafter rotated so that the base is in its elongated position to thereby retain the reusable swifter thereon with the lower cleaning surface of the swifter positioned in an operational condition to clean a surface;

d. the top surface of each section of the base portion having receiving means which receives a locking means which opens so that an open end of the locking means faces a transverse end of that section;

e. a disposable cleaning cloth having a body including a first side, a second side, a first end and a second end, the disposable cleaning cloth is retained about the two sections of the base portion after the sections are in the elongated locked condition, and the first end and a portion of each sides of the disposable cleaning cloth is placed into the receiving means of the first section and retained therein by the locking means and the second end and a portion of the first and second sides are inserted into the receiving means of the second section and retained therein by the locking means so that the disposable cleaning cloth is oriented in a cleaning position;

f. a first elongated side bar having an elongated receiving channel and a bottom wall supporting gripping means and a second elongated side bar having an elongated receiving channel and a bottom wall supporting gripping means, and after the disposable cleaning cloth is removed from the first and second section of the base portion and the sections are in their locked elongated condition, the first elongated side bar is placed onto a first side through its elongated channel and gripped thereon and the second elongated side bar is placed onto the second side through its elongated channel and gripped thereon so that the respective gripping means are adjacent the bottom surfaces of the base portions;

g. a brush member having a body with a top surface having gripping means thereon and a multiplicity of brushes extending from the body, the gripping means on the body attached to the gripping means on the first and second elongated side bars so that the brushes extend from the first and second base portions in a cleaning orientation; and h. a scrubbing pad having fibrous surfaces, and after the brush member is removed from the base portions, the scrubbing pad is retained on the two seconds of the base portion by the two gripping means on the elongated side bars.

5. A multipurpose cleaning apparatus, comprising:

a. a base portion having two sections which are rotatably connected so that the two sections are rotatable to an angle relative to each other when disconnected and locked to an elongated structure when connected, the base portion having two opposite transverse ends and two parallel oppositely disposed sides;

b. the two sections of the base portion each having a top surface and bottom surface, a handle retaining means affixed to the top surface of at least one of the two sections;

c. a reusable cleaning swifter having a lower cleaning surface and receiving means, the base portion rotated to its detached condition so that a respective transverse end of each section is respectively inserted into the receiving means on the reusable cleaning swifter, the sections thereafter rotated so that the base is in its elongated position to thereby retain the reusable swifter thereon with the lower cleaning surface of the swifter positioned in an operational condition to clean a surface;

d. the top surface of each section of the base portion having receiving means which receives a locking means which opens so that an open end of the locking means faces a transverse end of that section;

e. a disposable cleaning cloth having a body including a first side, a second side, a first end and a second end, the disposable cleaning cloth is retained about the two sections of the base portion after the sections are in the elongated locked condition, and the first end and a portion of each sides of the disposable cleaning cloth is placed into the receiving means of the first section and retained therein by the locking means and the second end and a portion of the first and second sides are inserted into the receiving means of the second section and retained therein by the locking means so that the disposable cleaning cloth is oriented in a cleaning position;

f. a first elongated side bar having an elongated receiving channel and a bottom wall supporting gripping means and a second elongated side bar having an elongated receiving channel and a bottom wall supporting gripping means, and after the disposable cleaning cloth is removed from the first and second sections of the base portion and the sections are in their locked elongated condition, the first elongated side bar is placed onto a first side through its elongated channel and gripped thereon and the second elongated side bar is placed onto the second side through its elongated channel and gripped thereon so that the respective gripping means are adjacent the bottom surfaces of the base portions;

g. a brush member having a body with a top surface having gripping means thereon and a multiplicity of brushes extending from the body, the gripping means on the body attached to the gripping means on the first and second elongated side bars so that the brushes extend from the first and second base portions in a cleaning orientation; and h. a scrubbing pad having fibrous surfaces, and after the brush member is removed from the base portions, the scrubbing pad is retained on the two seconds of the base portion by the two gripping means on the elongated side bars.

6. A multipurpose cleaning apparatus, comprising:

a. a base portion having two sections which are rotatably connected so that the two sections are rotatable to an angle relative to each other when disconnected and locked to an elongated structure when connected, the base portion having two opposite transverse ends and two parallel oppositely disposed sides;

b. the two sections of the base portion each having a top surface and bottom surface, a handle retaining means affixed to the top surface of at least one of the two sections;

c. a reusable cleaning swifter having a lower cleaning surface and receiving means, the base portion rotated to its detached condition so that a respective transverse end of each section is respectively inserted into a receiving means on the reusable cleaning swifter, the sections thereafter rotated so that the base is in its elongated position to thereby retain the reusable swifter thereon with the lower cleaning surface of the swifter positioned in an operational condition to clean a surface;

d. the top surface of each section of the base portion having receiving means which receives a locking means which opens so that an open end of the locking means faces a transverse end of that section;

e. a disposable cleaning cloth having a body including a first side, a second side, a first end and a second end, the disposable cleaning cloth is retained about the two sections of the base portion after the sections are in the elongated locked condition, and the first end and a portion of each sides of the disposable cleaning cloth is placed into the receiving means of the first section and retained therein by the locking means and the second end and a portion of the first and second sides are inserted into the receiving means of the second section and retained therein by the locking means so that the disposable cleaning cloth is oriented in a cleaning position;

f. a first elongated side bar having an elongated receiving channel and a bottom wall supporting gripping means and a second elongated side bar having an elongated receiving channel and a bottom wall supporting gripping means, and after the disposable cleaning cloth is removed from the first and second section of the base portion and the sections are in their locked elongated condition, the first elongated side bar is placed onto a first side through its elongated channel and gripped thereon and the second elongated side bar is placed onto the second side through its elongated channel and gripped thereon so that the respective gripping means are adjacent the bottom surfaces of the base portions; and g. a brush member having a body with a top surface having gripping means thereon and a multiplicity of brushes extending from the body, the gripping means on the body attached to the gripping means on the first and second elongated side bars so that the brushes extend from the first and second base portions in a cleaning orientation.

7. A multipurpose cleaning tool comprising:

a. a base portion having two sections which are rotatably connected so that the two sections are rotatable to an angle relative to each other when disconnected and locked to an elongated structure when connected, the base portion having two opposite transverse ends and two parallel oppositely disposed sides;

b. the two sections of the base portion each having a top surface and bottom surface, a handle retaining means affixed to the top surface of at least one of the two sections;

c. a reusable cleaning swifter having a lower cleaning surface and receiving means, the base portion rotated to its detached condition so that a respective transverse end of each section is respectively inserted into the receiving means on the reusable cleaning swifter, the sections thereafter rotated so that the base is in its elongated position to thereby retain the reusable swifter thereon with the lower cleaning surface of the swifter positioned in an operational condition to clean a surface;

d. the top surface of each section of the base portion having receiving means which receives a locking means which opens so that an open end of the locking means faces a transverse end of that section;

e. a disposable cleaning cloth having a body including a first side, a second side, a first end and a second end, the disposable cleaning cloth is retained about the two sections of the base portion after the sections are in the elongated locked condition, and the first end and a portion of each sides of the disposable cleaning cloth is placed into the receiving means of the first section and retained therein by the locking means and the second end and a portion of the first and second sides are inserted into the receiving means of the second section and retained therein by the locking means so that the disposable cleaning cloth is oriented in a cleaning position;

f. a first elongated side bar having an elongated receiving channel and a bottom wall supporting gripping means and a second elongated side bar having an elongated receiving channel and a bottom wall supporting gripping means, and after the disposable cleaning cloth is removed from the first and second sections of the base portion and the sections are in their locked elongated condition, the first elongated side bar is placed onto a first side through its elongated channel and gripped thereon and the second elongated side bar is placed onto the second side through its elongated channel and gripped thereon so that the respective gripping means are adjacent the bottom surfaces of the base portions; and g. a scrubbing pad having fibrous surfaces, and after the brush member is removed from the base portions, the scrubbing pad is retained on the two seconds of the base portion by the two gripping means on the elongated side bars.

8. A multipurpose cleaning apparatus, comprising:

a. a base portion having two parallel oppositely disposed sides, a top having means for retaining a handle, and a bottom surface;

b. a first elongated side bar having an elongated receiving channel and a bottom wall supporting gripping means and a second elongated side bar having an elongated receiving channel and a bottom wall supporting gripping means, the first elongated side bar is placed onto a first side through an elongated channel and gripped thereon and the second elongated side bar is placed onto the second side through an elongated channel and gripped thereon so that the respective gripping means are adjacent the bottom surfaces of the base portions; and c. a brush member having a body with a top surface having gripping means thereon and a multiplicity of brushes extending from the body, the gripping means on the body attached to the gripping means on the first and second elongated side bars so that the brushes extend from the first and second base portions in a cleaning orientation.

9. A multipurpose cleaning tool in accordance with claim 8, further comprising a scrubbing pad having fibrous surfaces, and after the brush member is removed from the base portions, the scrubbing pad is retained on the two sections of the base portion by the two gripping means on the elongated side bars.

10. A four-in-one multipurpose cleaning tool comprising:

a. a base portion comprised of first base portion and a second base portion wherein each base portion is comprised of a top surface, a bottom surface, a second side edge, a first side edge, a first edge, and a second edge;

b. a handle member for retaining a handle comprised of a handle retaining portion moveably attached to said second base portion;

c. a first portion well housing within the top surface of said first base portion where said first portion well housing further comprises a well bar for retaining a moveable first hinge locking clasp wherein the locking clasp is comprised of a first and second locking tooth for frictionally fitted within said well;

d. a second portion well housing within the top surface of said second base portion where said second portion well housing further comprises a well bar for retaining a moveable second hinge locking clasp wherein the locking clasp is comprised of a first and second locking tooth for frictionally fitting within said well;

e. the first base portion and the second base portion being in a locked position;

f. a first internal side well within said first edge wherein the first internal side well is comprised of a first internal lip wherein said lip is horizontally and centrally positioned within the well;

g. a detachably attachable first side bar comprised of a second edge, and a top surface, and a bottom portion wherein said bottom portion is configured with a velcro strip, and where said bar is configured to accept said first internal lip of said first internal well;

h. a second internal side well within said second edge wherein the second internal side well is comprised of a second internal lip and wherein said lip is horizontally and centrally positioned within the well; and g. a detachably attachable second side bar comprised of a second edge, and a top surface, and a bottom portion wherein said bottom portion is configured with a velcro strip, and where said bar is configured to accept said second internal lip of said second internal well.

11. A multipurpose cleaning apparatus comprising:

a. a base portion comprised of first base portion and a second base portion wherein each base portion is comprised of a top surface, a bottom surface, a second side edge, a first side edge, a first edge, and a second edge;

b. a handle member for retaining a handle comprised of a handle retaining portion moveably attached to said second base portion;

c. a first portion well housing within the top surface of said first base portion where said first portion well housing further comprises a well bar for retaining a moveable first hinge locking clasp wherein the locking clasp is comprised of a first and second locking tooth for frictionally fitted within said well;

d. a second portion well housing within the top surface of said second base portion where said second portion well housing further comprises a well bar for retaining a moveable second hinge locking clasp wherein the locking clasp is comprised of a first and second locking tooth for frictionally fitting within said well;

e. a first internal side well within said first edge wherein the first internal side well is comprised of a first internal lip wherein said lip is horizontally and centrally positioned within the well;

f. a detachably attachable first side bar comprised of a second edge, and a top surface, and a bottom portion wherein said bottom portion is configured with a velcro strip, and where said bar is configured to accept said first internal lip of said first internal well in an unfolded condition;

g. a second internal side well within said second edge wherein the second internal side well is comprised of a second internal lip and wherein said lip is horizontally and centrally positioned within the well; and h. a detachably attachable second side bar comprised of a second edge, and a top surface, and a bottom portion wherein said bottom portion is configured with a velcro strip, and where said bar is configured to accept said second internal lip of said second internal well in an unfolded condition.

* * * * *